US007597567B2

(12) United States Patent
Tanaka et al.

(10) Patent No.: US 7,597,567 B2
(45) Date of Patent: Oct. 6, 2009

(54) CONNECTOR PROTECTIVE COVER AND CONNECTOR

(75) Inventors: Yoko Tanaka, Shinagawa (JP); Mitsuru Kobayashi, Shinagawa (JP); Tadashi Kumamoto, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 60 days.

(21) Appl. No.: 11/472,302

(22) Filed: Jun. 22, 2006

(65) Prior Publication Data

US 2007/0093095 A1 Apr. 26, 2007

(30) Foreign Application Priority Data

Oct. 25, 2005 (JP) ..... 2005-309270

(51) Int. Cl.
*H01R 13/44* (2006.01)

(52) U.S. Cl. ..... 439/135; 439/149

(58) Field of Classification Search ..... 439/135, 439/148, 149, 940, 136, 139
See application file for complete search history.

(56) References Cited

U.S. PATENT DOCUMENTS 4,795,354 A * 1/1989 Owen ..... 439/137
5,106,313 A * 4/1992 Lwee et al. ..... 439/135
5,547,388 A * 8/1996 Hill ..... 439/135
6,206,577 B1 * 3/2001 Hall et al. ..... 385/53
6,315,584 B1 * 11/2001 Greenside et al. ..... 439/135
6,722,901 B2 * 4/2004 Kim et al. ..... 439/135
6,755,672 B2 * 6/2004 Lai et al. ..... 439/135
7,037,121 B1 * 5/2006 Gray, Jr. ..... 439/135
7,153,147 B2 * 12/2006 Li et al. ..... 439/135
2005/0048846 A1 * 3/2005 Suzuki et al. ..... 439/660
2005/0277316 A1 * 12/2005 Cohen ..... 439/135
2006/0047880 A1 * 3/2006 Lindblom et al. ..... 710/305

FOREIGN PATENT DOCUMENTS

JP 07-220797 8/1995

* cited by examiner

*Primary Examiner*—Hien Vu
(74) *Attorney, Agent, or Firm*—Staas & Halsey LLP

(57) ABSTRACT

A connector protective cover that is configured to be arranged over an inserting portion of a connector is disclosed. The inserting portion is exposed within an enclosure portion at an edge of a shield cover and is configured by arranging a signal contact and a ground contact at a protruding plate portion of a molded part. The connector protective cover includes a top plate portion, plural side wall portions, an opening defined by the side wall portions, and a spring portion having spring characteristics that is configured to tighten engagement with the inserting portion by spring force.

6 Claims, 26 Drawing Sheets

CONNECTOR PROTECTIVE COVER AND CONNECTOR

BACKGROUND OF THE INVENTION

1. Field of the Invention

The present invention relates to a connector protective cover that is configured to be arranged over an inserting portion at the tip of a cable side connector attached to an end of a cable.

2. Description of the Related Art

A cable side connector may be used by being connected to a substrate side connector that is attached to an edge of a printed board of an electronic apparatus, for example.

It is noted that contacts are arranged and exposed at an insertion portion at the tip of the cable side connector. The insertion portion of the cable side connector is preferably covered and protected while the cable with the cable side connector is being shipped from a factory, for example, and uncovered when the cable side connector is to be used (e.g., connected to the substrate side connector).

A cover for covering and protecting the cable side connector preferably has holding force for holding onto the cable side connector so that it may not be easily detached from the cable side connector.

SUMMARY OF THE INVENTION

According to one aspect of the present invention, a connector protective cover with a simple configuration is provided that may not be easily detached while being carried/handled but may be detached upon being pulled with adequate force.

According to another aspect of the present invention, a connector that is configured to realize secure engagement with a connector protective cover is provided.

According to one specific embodiment of the present invention, a connector protective cover is provided that is configured to be arranged over an inserting portion of a connector which inserting portion is exposed within an enclosure portion at an edge of a shield cover and is configured by arranging a signal contact and a ground contact at a protruding plate portion of a molded part, the connector protective cover including:

a top plate portion;

a plurality of side wall portions;

an opening defined by the side wall portions; and a spring portion having spring characteristics and being configured to tighten engagement with the inserting portion by spring force.

According to another specific embodiment of the present invention, a connector protective cover is provided that is configured to be arranged over an inserting portion of a connector which inserting portion is exposed within an enclosure portion at an edge of a shield cover of the connector and is configured by arranging a signal contact and a ground contact at a protruding plate portion of a molded part, the connector protective cover including:

a top plate portion;

a plurality of side wall portions;

an opening defined by the side wall portions; and one or more protrusions arranged on one or more inner faces of the side wall portions, the protrusions being configured to come into contact with the inserting portion and tighten engagement with the inserting portion by frictional force.

According to another specific embodiment of the present invention, a connector is provided that includes:

an inserting portion that is exposed within an enclosure portion at an edge of a shield cover and is configured by arranging a signal contact and a ground contact at a protruding plate portion of a molded part;

wherein the inserting portion includes a protrusion that is configured to come into contact with an inner face of a connector protective cover and tighten engagement with the connector protective cover by frictional force.

DESCRIPTION OF THE PREFERRED EMBODIMENTS

In the following, preferred embodiments of the present invention are described with reference to the accompanying drawings.

First Embodiment

In the following, descriptions are given of a cable side connector on which a connector protective cover according to an embodiment of the present invention is used.

Figure 1:
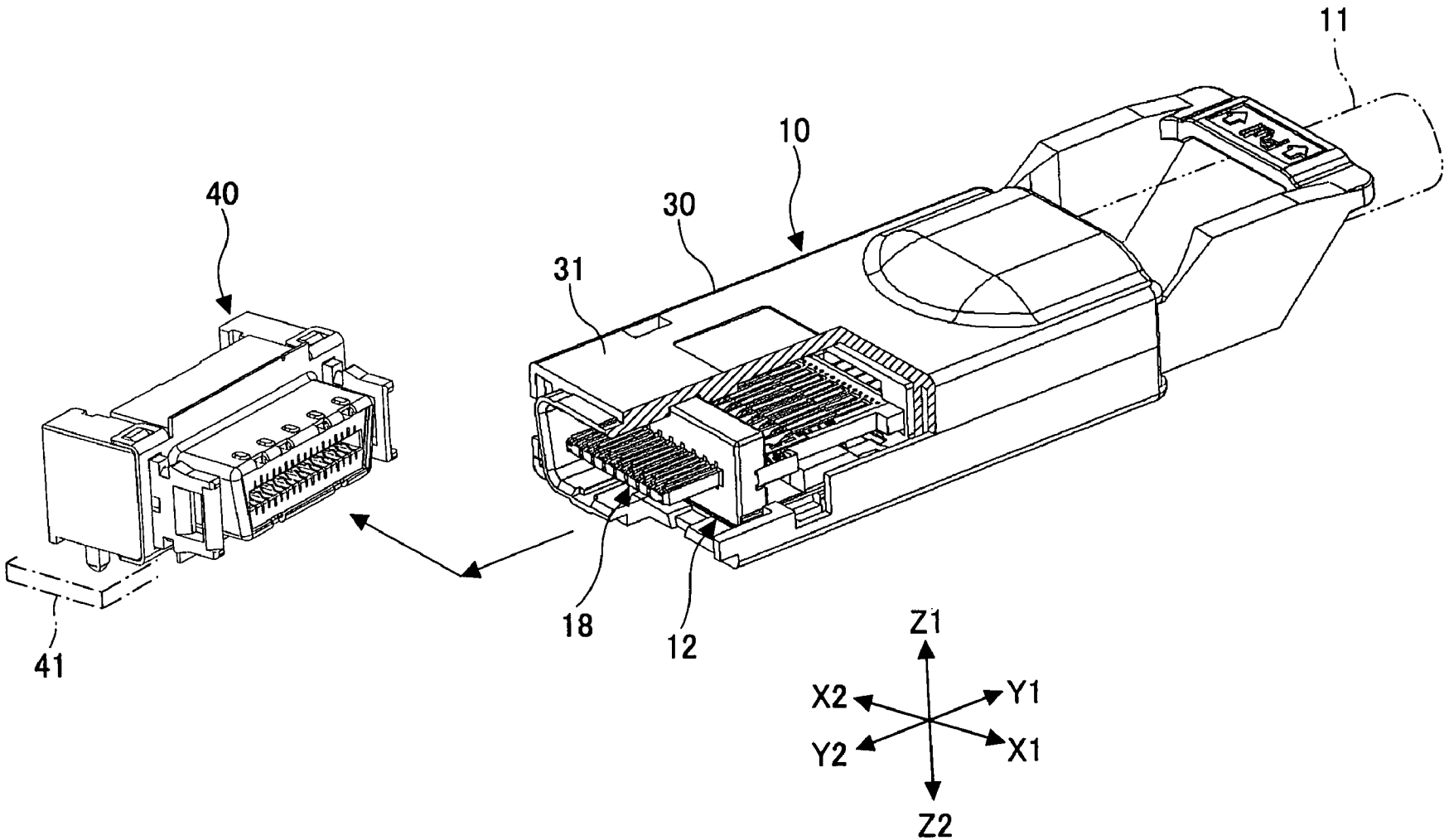
FIG. 1 is a perspective view of a cable side connector on which a connector protective cover according to an embodiment of the present invention is used and a corresponding substrate side connector.

FIG. 1 is a diagram showing a cable side connector 10 on which a connector protective cover according to an embodiment of the present invention is used, and a corresponding substrate side connector 40. The cable side connector 10 is attached to an end of a cable 11 and is configured to be connected to the substrate side connector 40. The substrate side connector 40 is attached to an edge of a printed board 41 of an electronic apparatus. It is noted that in the following descriptions, directions X1-X2, Y1-Y2, and Z1-Z2 respectively represent width directions, length directions, and height directions of the cable side connector 10. Also, direction Y1 represents a backward direction and Y2 represents a forward direction (i.e., inserting direction for connecting the cable side connector 10 to the substrate side connector 40).

The cable side connector 10 includes a shield cover assembly 30 and a connector module 12 that is arranged inside the shield cover assembly 30.

Figure 2:
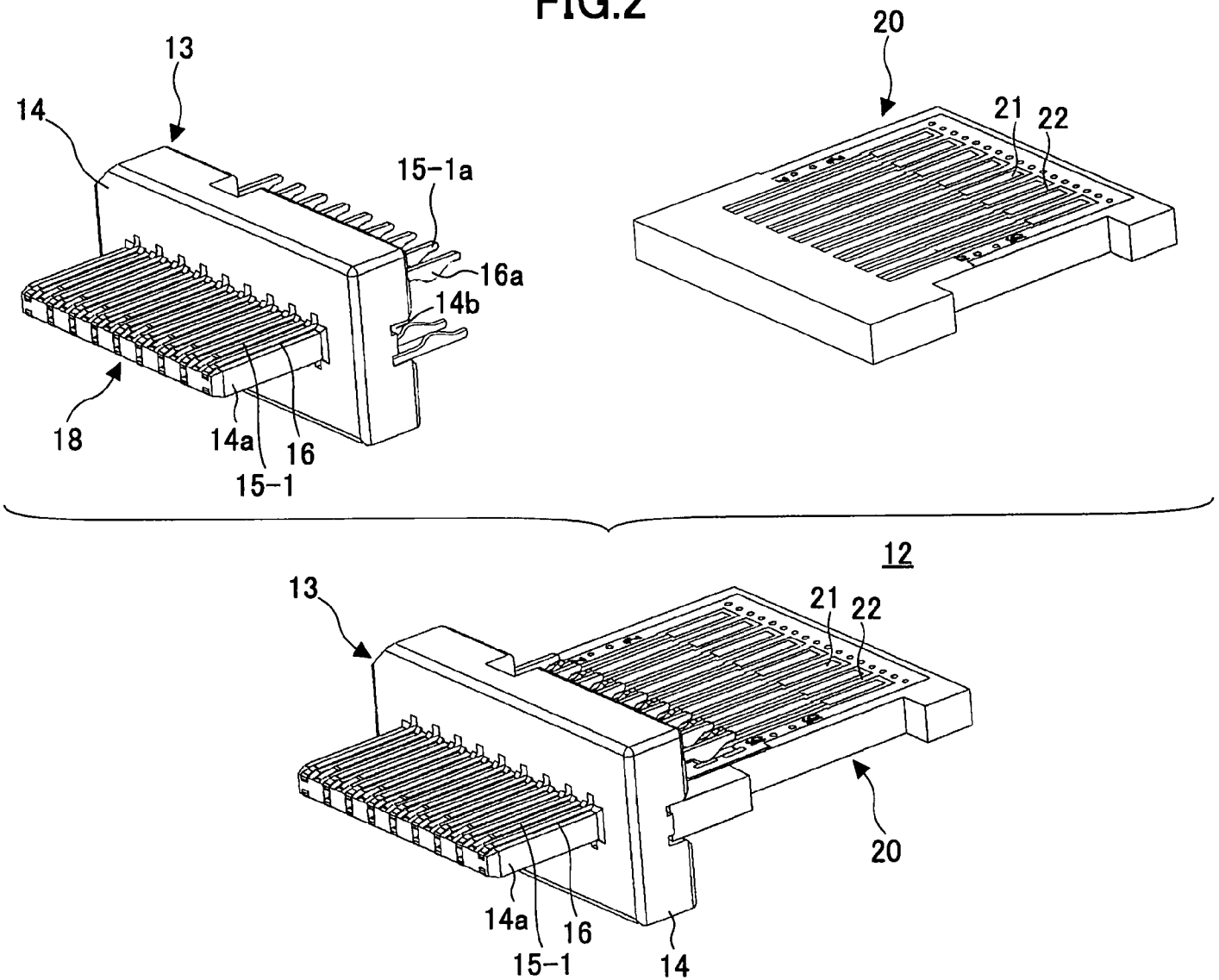
FIG. 2 is a diagram showing a configuration of a connector module of the cable side connector of FIG. 1.

FIG. 2 is a diagram showing a configuration of the contact module 12. As is shown in this drawing, the contact module 12 includes a contact assembly 13 and a printed board 20 attached to the contact assembly 30.

Figure 3:
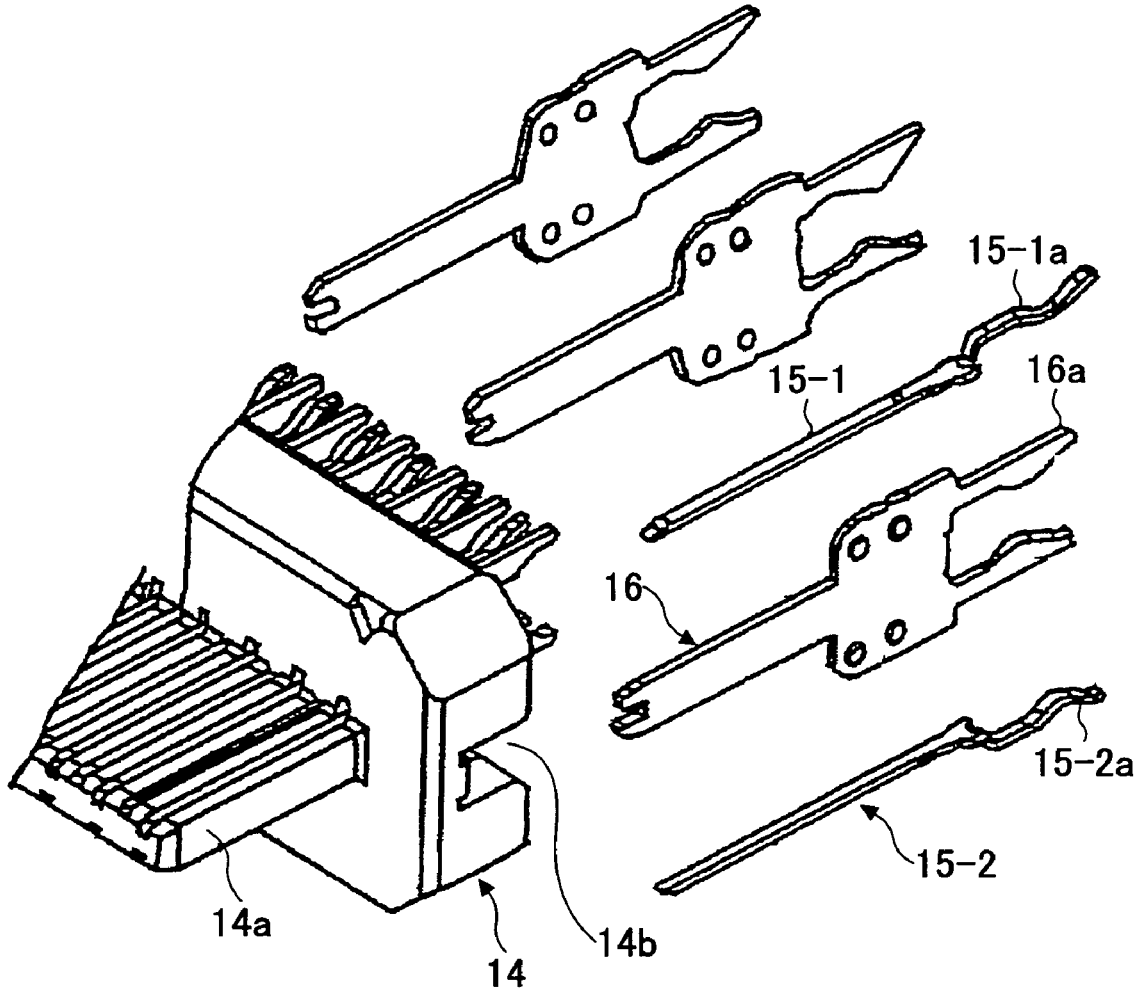
FIG. 3 is an exploded partial view of a contact assembly of the contact module of FIG. 2.

FIG. 3 is a partial exploded view of the contact assembly 13. As is shown in this drawing, the contact assembly 13 includes a molded part 14 having a rear side from which pairs of signal contacts 15-1, 15-2 and ground contacts 16 are inserted to be press fit to the molded part 14. The molded part 14 includes a plate portion 14*a* that protrudes forward from the front side of the molded part 14. The signal contacts 15-1, 15-2, and the ground contacts 16 are arranged at the plate portion 14*a*. This plate portion 14*a* with the signal contacts 15-1, 15-2 and the ground contacts 16 arranged thereto corresponds to an inserting portion 18 of the cable side connector 10 that is inserted into the substrate side connector 40. It is noted that terminal portions 15-1*a*, 15-2*a*, and 16*a* are arranged to protrude from the rear side of the molded part 14.

The printed board 20 has signal patterns 21 and ground patterns 22 formed on its upper face and lower face. The signal patterns 21 correspond to plural parallel strips formed on the upper and lower faces of the printed board 20. The ground patterns 22 correspond to the remaining pattern portions of the printed board 20.

It is noted that the front side edge of the printed board 20 is arranged to engage a groove portion 14*b* of the molded part 14, ends of the signal patterns 21 are soldered to the terminal portions 15-1*a* and 15-2*a*, and ends of the ground terminals 22 are soldered to the terminal portions 16*a*.

As is shown in FIG. 1, the inserting portion 18 protrudes from the molded part 14 within an enclosure portion 31 at the front edge of the shield cover assembly 30.

In the following, descriptions are given of connector protective covers according to embodiments of the present invention that are configured to cover the inserting portion 18 to protect the contacts of the cable side connector 10 while the cable side connector 10 is being transported, processed, or handled in some other way.

The connector protective cover may be a resin molded article that can be detached when the cable side connector 10 is to be used (e.g., connected to a substrate side cable).

The connector protective cover is preferably arranged over the inserting portion 18 in a manner such that it does not come off easily but may be properly detached without damaging the inserting portion 18 upon being pulled with adequate force.

Figure 4:
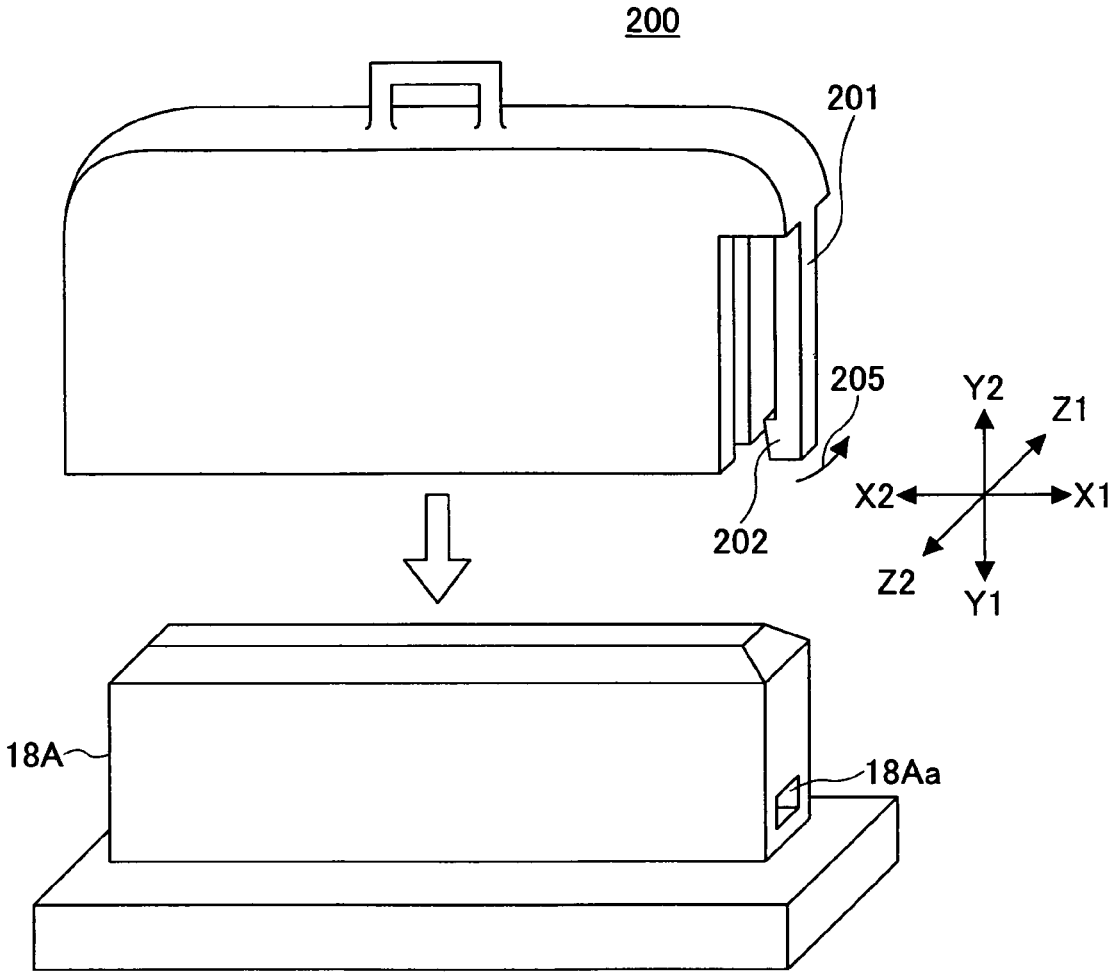
FIG. 4 is a diagram showing a connector protective cover according to a first embodiment of the present invention and a corresponding inserting portion.

FIG. 4 is a diagram showing a connector protective cover 200 according to a first embodiment of the present invention and a corresponding inserting portion 18A. The connector protective cover 200 is arranged into a size suitable for engagement with the inserting portion 18A, and includes a side wall portion 201 corresponding to a short side wall portion that is arranged at the X1 side (long side edge). The side wall portion 201 is arranged into a cantilever structure, and this cantilever side wall portion 201 has a protruding portion 202 protruding inward at its extending end. The cantilever side wall portion 201 extends in the Y1 direction and is configured to bend in the direction indicated by arrow 205.

The inserting portion 18A includes a concave portion 18Aa at its Y1 side end.

The connector protective cover 200 is configured to be arranged over the inserting portion 18A with the cantilever side wall portion 201 being slightly bent in the X1 direction and the protruding portion 202 engaging the concave portion 18Aa.

It is noted that the connector protective cover 200 according to the present embodiment may also be used on an inserting portion 18 that does not include the concave portion 18Aa as is described above.

Second Embodiment

Figure 5:
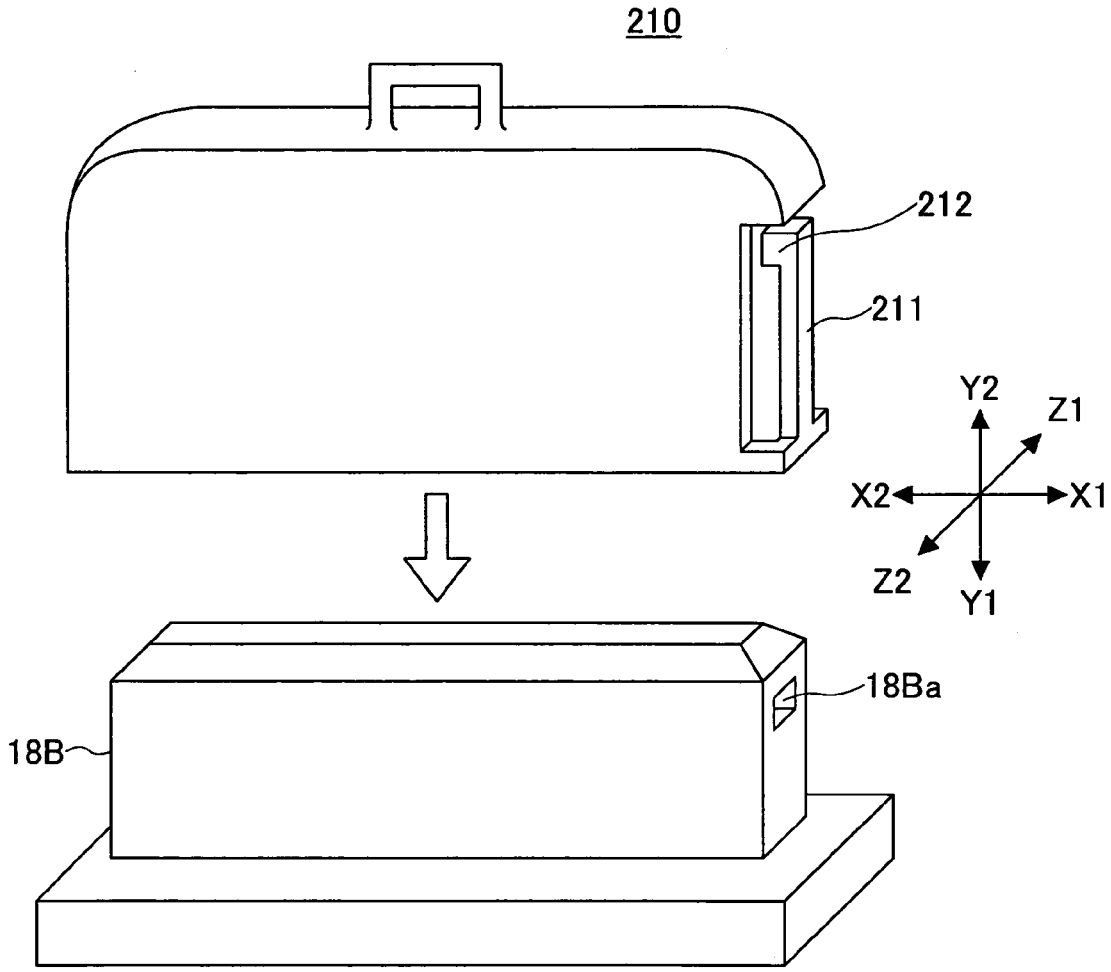
FIG. 5 is a diagram showing a connector protective cover according to a second embodiment of the present invention and a corresponding inserting portion.

FIG. 5 is a diagram showing a connector protective cover 210 according to a second embodiment of the present invention and a corresponding inserting portion 18B. The connector protective cover 210 according to the present embodiment includes a cantilever side wall portion 211 extending in the Y2 direction arranged at the X1 side end corresponding to a long side edge. The cantilever side wall portion 211 includes a protruding portion 212 that protrudes inward at its extending end.

The inserting portion 18B includes a concave portion 18Ba at its Y2 side end.

The connector protective cover 210 is configured to be arranged over the inserting portion 18B with the cantilever side wall portion 211 being slightly bent in the X1 direction and the protruding portion 212 engaging the concave portion 18Ba.

It is noted that the connector protective cover 210 according to the present embodiment may also be used on an inserting portion 18 that does not include the concave portion 18Ba as is described above.

Third Embodiment

Figure 6:
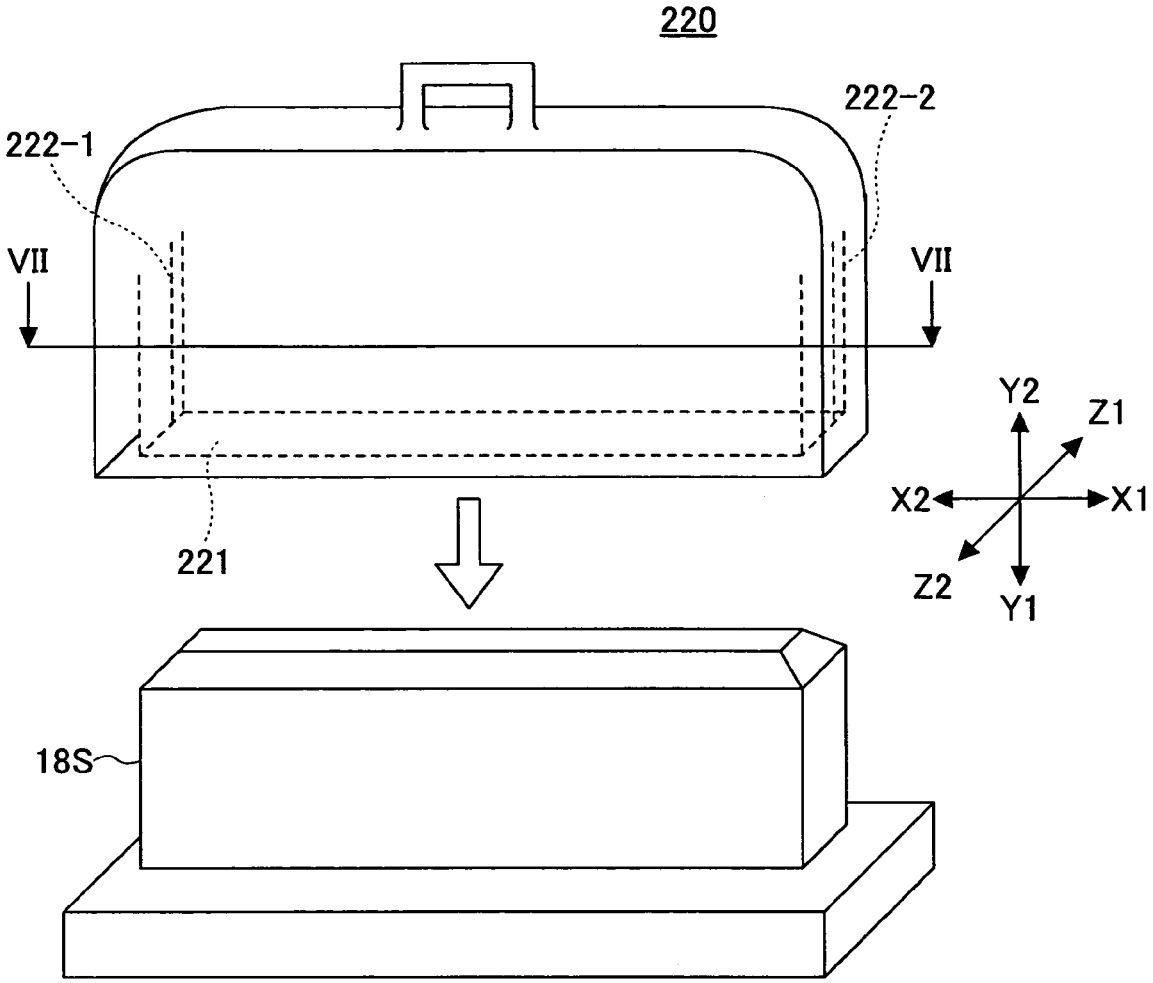
FIG. 6 is a diagram showing a connector protective cover according to a third embodiment of the present invention and a corresponding inserting portion.
Figure 7:
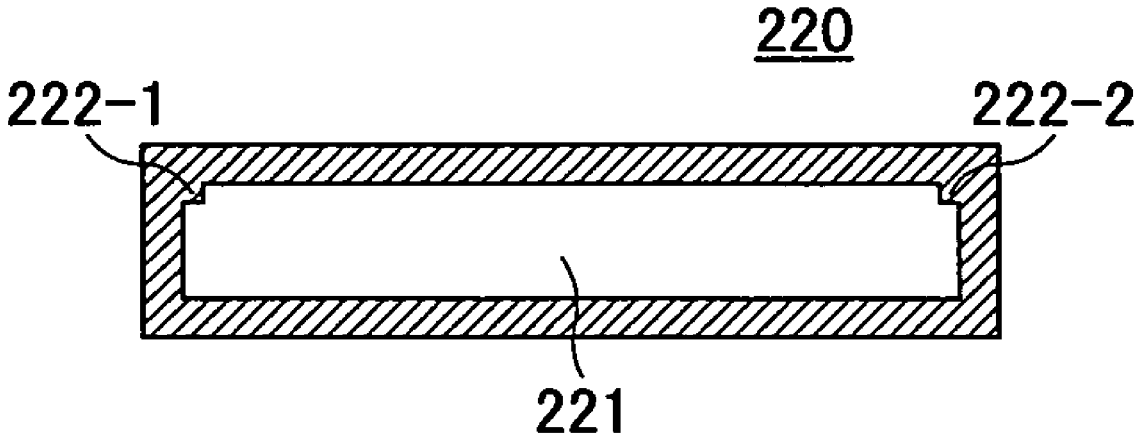
FIG. 7 is a cross-sectional diagram of the connector protective cover of FIG. 6.

FIG. 6 is a diagram showing a connector protective cover 220 according to a third embodiment of the present invention and an inserting portion 18S on which the connector protective cover 220 may be used. FIG. 7 is a cross-sectional diagram of the connector protective cover 220. As is shown in FIGS. 6 and 7, the connector protective cover 220 according to the present embodiment has an opening 221 that is rectangular in cross-section. Protruding portions 222-1 and 222-2 are arranged at two corners of the four corners of the rectangular cross-section, the two corners being on one long side of the rectangle. The connector protective cover 220 is configured to be arranged over the inserting portion 18S with the protruding portions 222-1 and 222-2 being pushed onto the corner portions of the inserting portion 18S so that the connector protective cover 220 may be held by frictional force.

Fourth Embodiment

Figure 8:
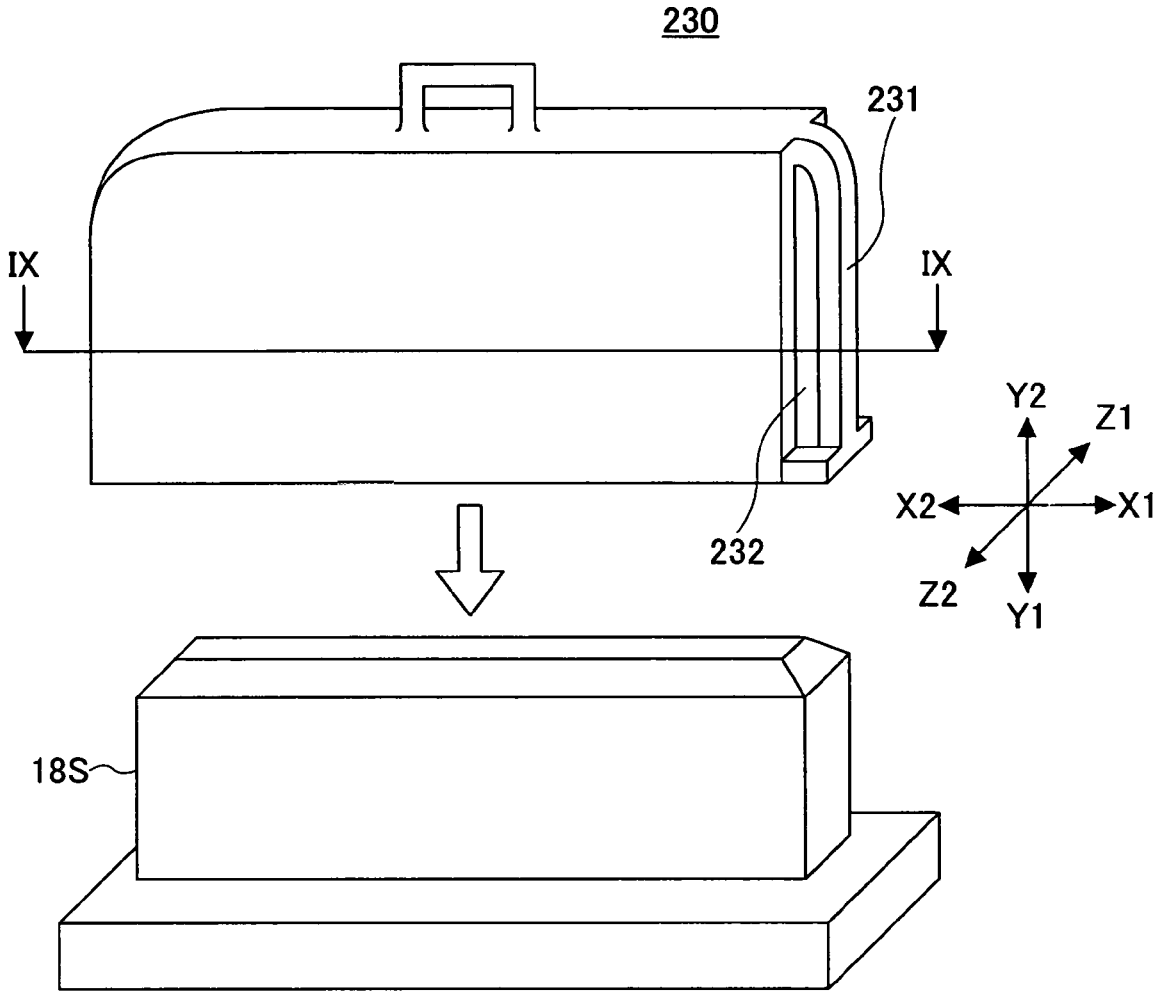
FIG. 8 is a diagram showing a connector protective cover according to a fourth embodiment of the present invention and a corresponding inserting portion.
Figure 9:
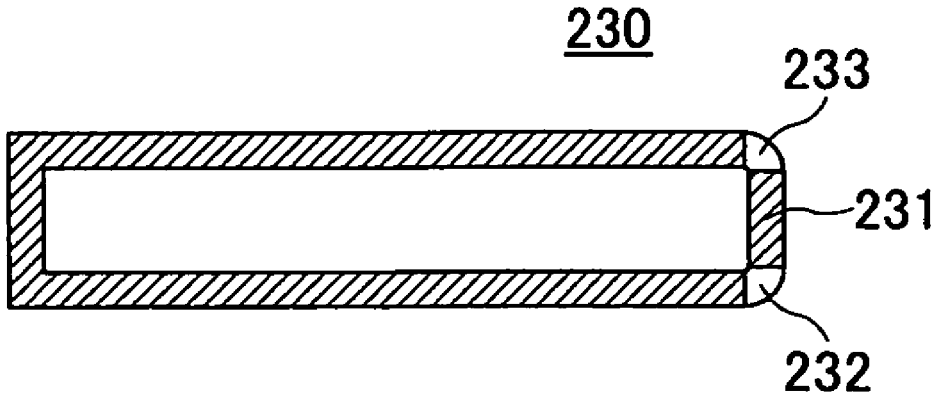
FIG. 9 is a cross-sectional diagram of the connector protective cover of FIG. 8.

FIG. 8 is a diagram showing a connector protective cover 230 according to a fourth embodiment of the present invention and the inserting portion 18S on which the connector protective cover 230 may be used. FIG. 9 is a cross-sectional diagram of the connector protective cover 230. As is shown in FIGS. 8 and 9, the connector protective cover 230 according to the present embodiment includes a side wall portion 231 having a doubly-supported beam structure on the X1 side corresponding to one long side edge. The doubly-supported beam side wall portion 231 is created by cutting out two corner portions 232 and 233 (see FIG. 9) of the X1 side wall of the connector protective cover 230. The connector protective cover 230 is configured to be arranged over the inserting portion 18S with the doubly-supported beam side wall portion 231 being pushed onto a side face of the inserting portion 18S by its spring force so that the connector protective cover may be held by frictional force.

Fifth Embodiment

Figure 10:
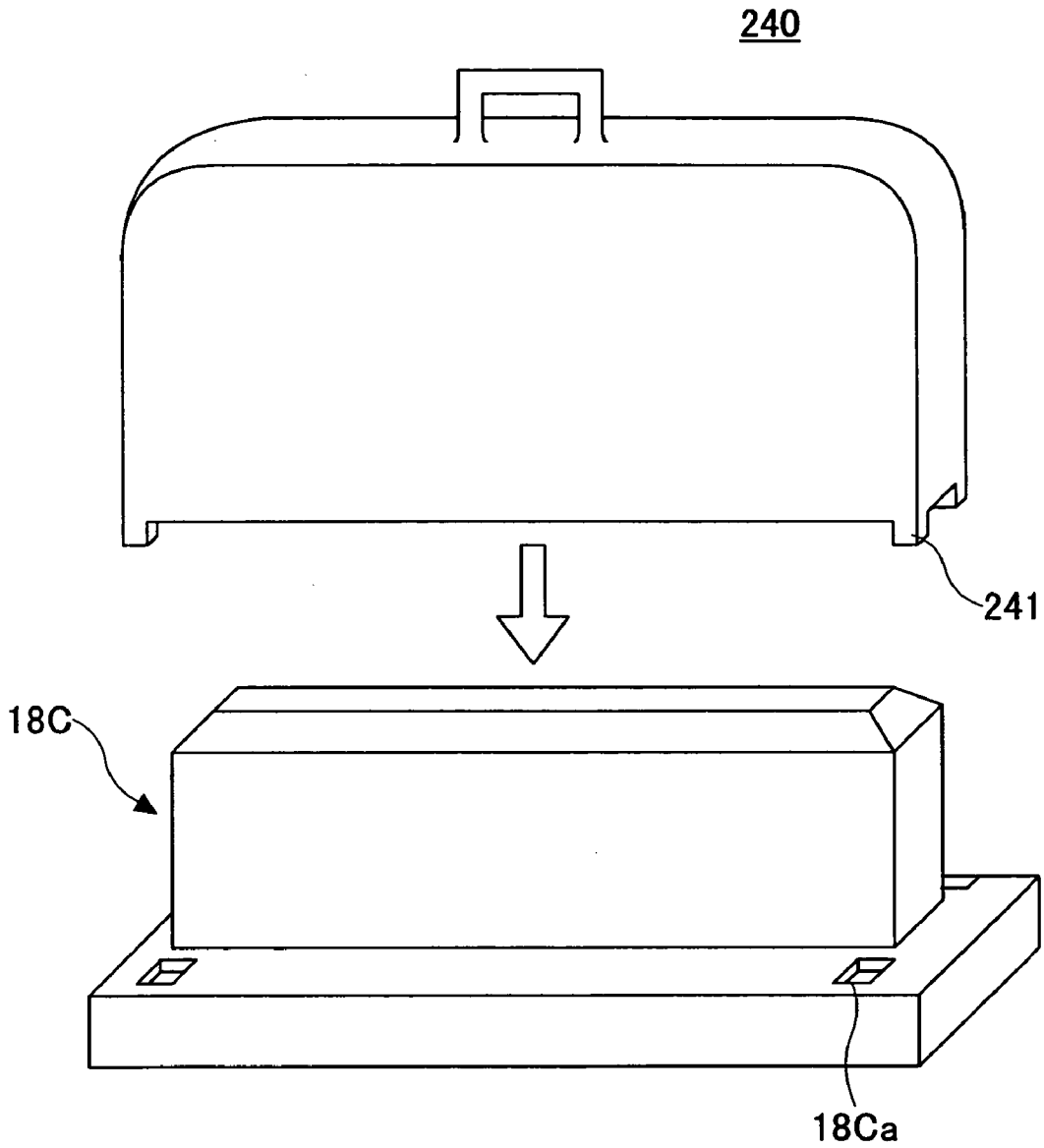
FIG. 10 is a diagram showing a connector protective cover according to a fifth embodiment of the present invention and a corresponding inserting portion.

FIG. 10 is a diagram showing a connector protective cover 240 according to a fifth embodiment of the present invention and an inserting portion 18C on which the connector protective cover 240 may be used. The connector protective cover 240 according to the present embodiment includes protrusions 241 protruding from the four corners of the periphery of the opening of the connector protective cover 240. The inserting portion 18C includes concave portions 18Ca at the corners of its Y1 side base portion. The connector protective cover 240 is configured to be arranged over the inserting portion 18C with the protruding portions 241 being press-fit into the corresponding concave portions 18Ca.

Sixth Embodiment

Figure 11:
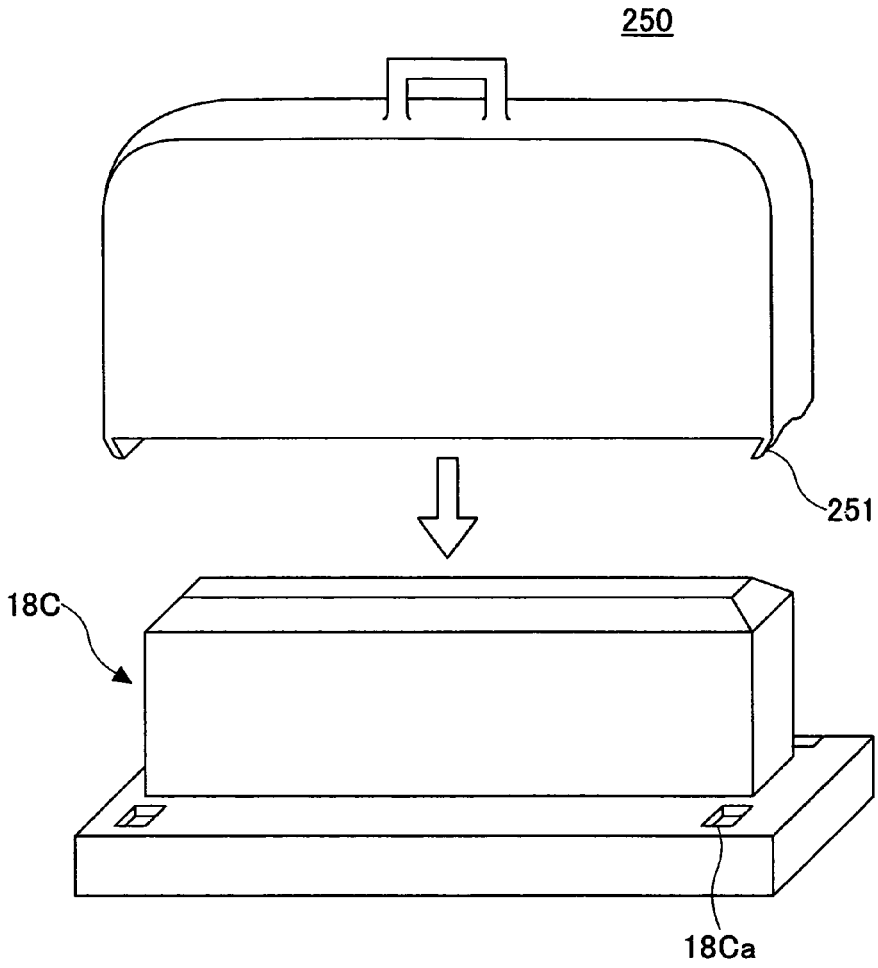
FIG. 11 is a diagram showing a connector protective cover according to a sixth embodiment of the present invention and a corresponding inserting portion.

FIG. 11 is a diagram showing a connector protective cover 250 according to a sixth embodiment of the present invention, and the inserting portion 18C on which the connector protective cover 250 may be used. The connector protective cover 250 includes spring protruding portions 251 arranged at the four corners of the periphery of the opening of the connector protective cover 250.

Figure 12:
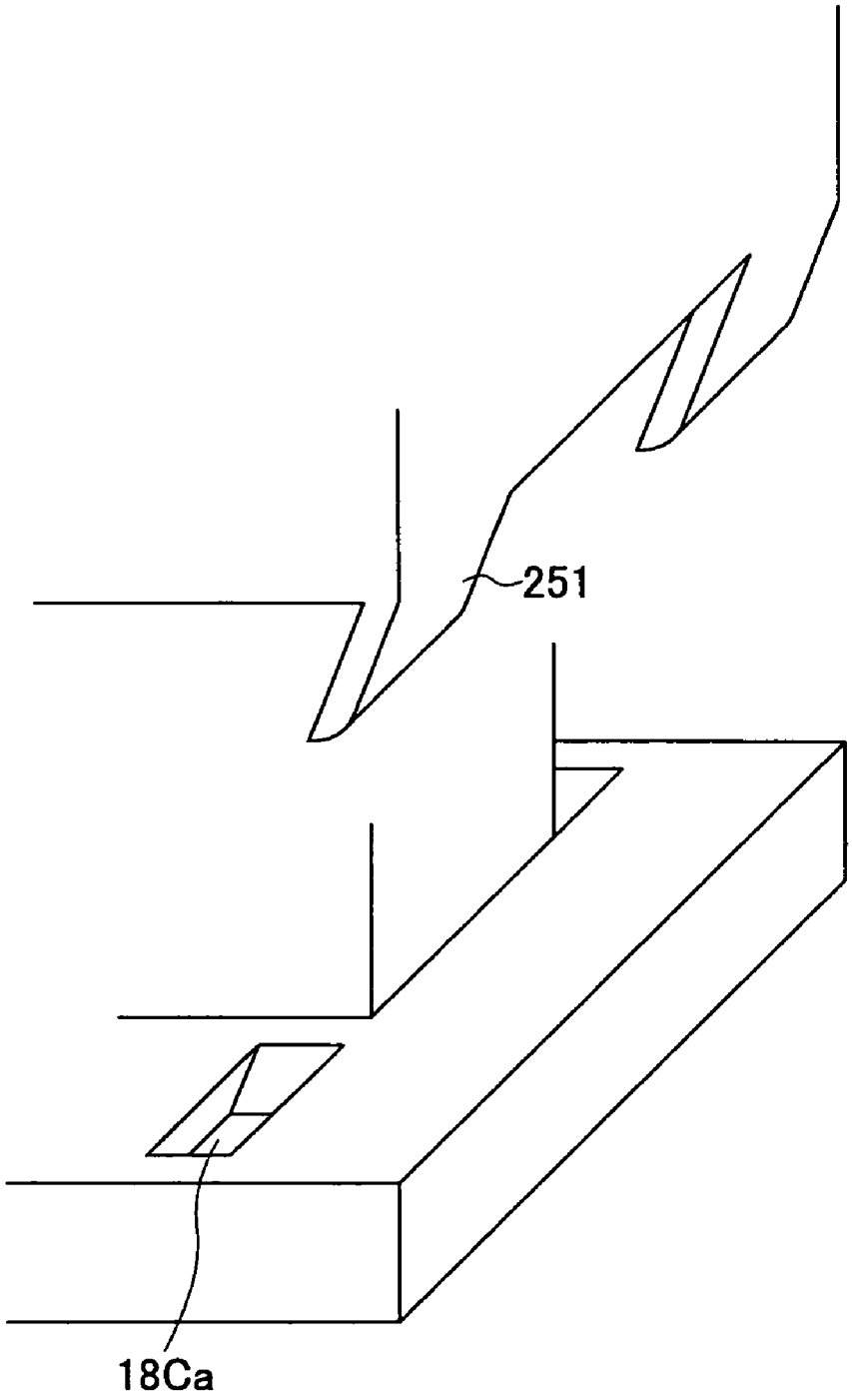
FIG. 12 is a partial enlarged view of the connector protective cover of FIG. 11.

FIG. 12 is a partial enlarged view of the spring protruding portions 251. As is shown in this drawing, the spring protruding portions 251 are curved inward so that they may have spring characteristics.

The connector protective cover 250 is configured to be arranged over the inserting portion 18C with the spring protruding portions 251 engaging the corresponding concave portions 18Ca and being pushed onto the side face of the concave portions 18Ca.

Seventh Embodiment

It is noted that connector protective covers according to seventh through twelfth embodiments of the present invention described below include opposing protrusions that come into frictional contact with long side wall portions of the inserting portion 18.

Figure 13:
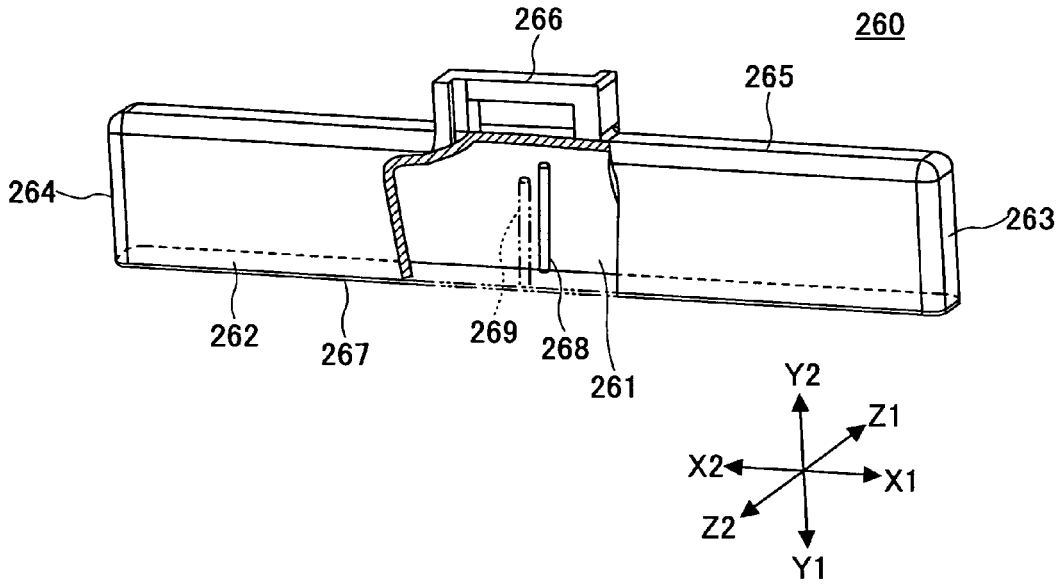
FIG. 13 is a diagram showing a connector protective cover according to a seventh embodiment of the present invention.

FIG. 13 is a diagram showing a connector protective cover 260 according to a seventh embodiment of the present invention. The connector protective cover 260 includes long side walls 261, 262, short side walls 263, 264, a top plate 265, and a handle portion 266 that is arranged on the top plate 265. The Y1 side end of the connector protective cover 260 is arranged into a rectangular opening 267. Opposing protrusions 268 and 269 having semi-circular cross-sections and extending in the Y directions are formed along center lines of the inner faces of the long side walls 261 and 262, respectively.

Figure 14:
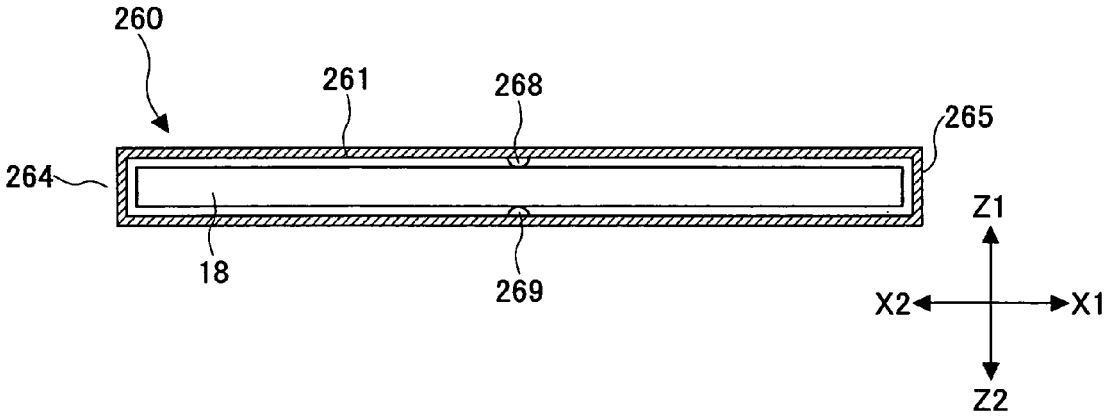
FIG. 14 is a cross-sectional diagram showing the connector protective cover of FIG. 13 being arranged over an inserting portion.

FIG. 14 is a cross-sectional diagram of the connector protective cover 260. As is shown in this drawing, the connector protective cover 260 is configured to cover the inserting portion 18 in a manner such that the inserting portion 18 is arranged between the opposing protrusions 268 and 269 and held by frictional force. It is noted that in the present embodiment, the inner faces of the long side walls 261 and 262 do not come into contact with the inserting portion.

Eighth Embodiment

It is noted that connector protective covers according to eighth through twelfth embodiments of the present invention correspond to modified embodiments of the connector protective cover 260 according to the seventh embodiment. Accordingly, in the following descriptions, component parts that are identical to those of the connector protective cover 260 shown in FIG. 13 are given the same reference numerals.

Figure 15:
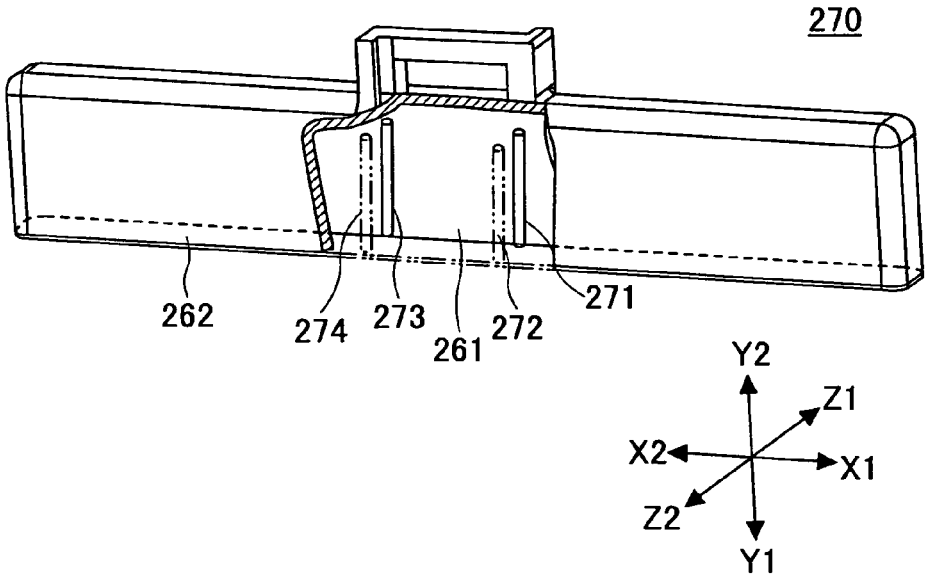
FIG. 15 is a diagram showing a connector protective cover according to an eighth embodiment of the present invention.

FIG. 15 is a diagram showing a connector protective cover 270 according to the eighth embodiment of the present invention. The connector protective cover 270 includes a first set of opposing protrusions 271, 272, and a second set of opposing protrusions 273, 274 arranged at the inner faces of the long side walls 261 and 262.

Figure 16:
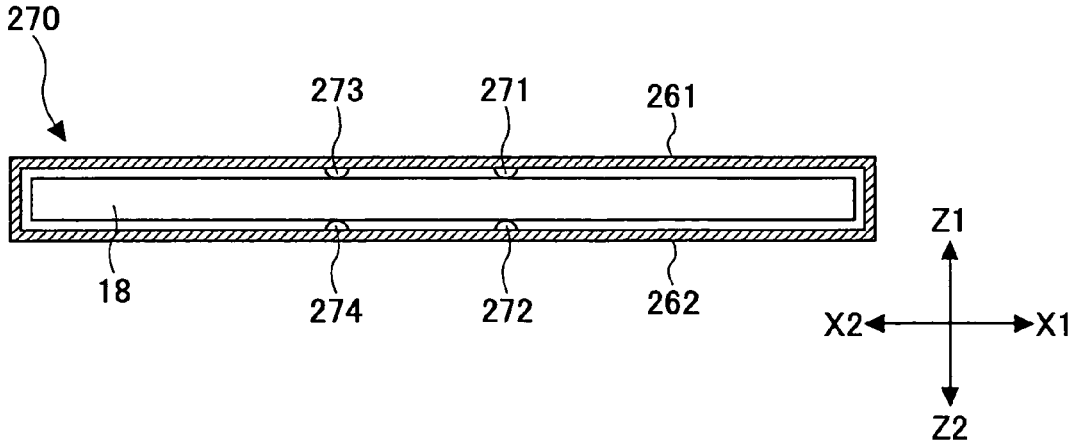
FIG. 16 is a cross-sectional diagram showing the connector protective cover of FIG. 15 being arranged over an inserting portion.

FIG. 16 is a cross-sectional diagram of the connector protective cover 270. As is shown in this drawing, the connector protective cover 270 is configured to cover the inserting portion 18 in a manner such that the inserting portion 18 is arranged between the opposing protrusions 271 and 272 of the first set, and the opposing protrusions 273 and 274 of the second set so that the inserting portion 18 may be held by frictional force. It is noted that in this embodiment the inner faces of the long side walls 261 and 262 do not come into contact with the inserting portion 18.

Ninth Embodiment

Figure 17:
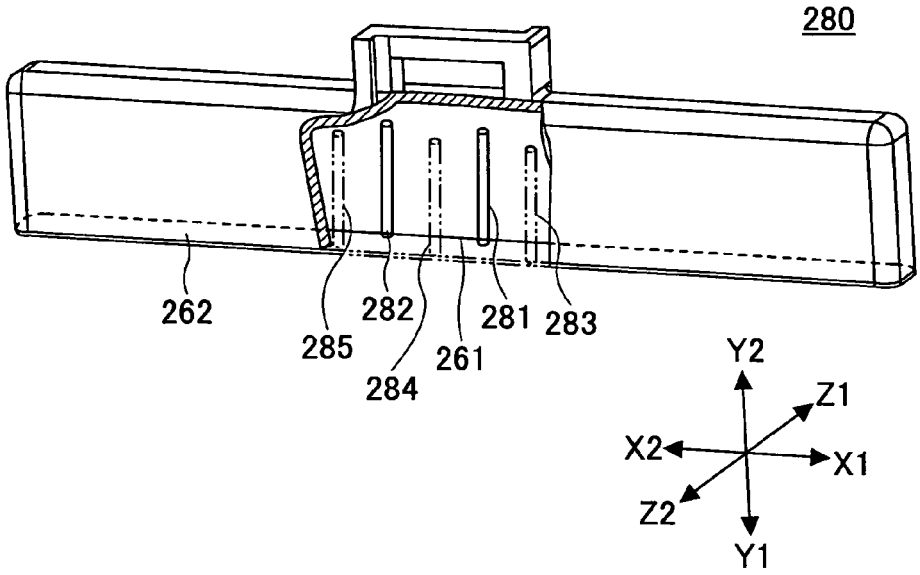
FIG. 17 is a diagram showing a connector protective cover according to a ninth embodiment of the present invention.

FIG. 17 is a diagram showing a connector protective cover 280 according to a ninth embodiment of the present invention. The connector protective cover 280 includes protrusions 281 and 282 arranged on the inner face of the long side wall 261, and protrusions 283, 284, and 285 arranged on the inner face of the long side wall 262. It is noted that in the present embodiment, the protrusions 281 and 282 of the long side wall 261 do not have opposing positional relationships with the protrusions 283, 284, and 285 of the long side wall 262.

Figure 18:
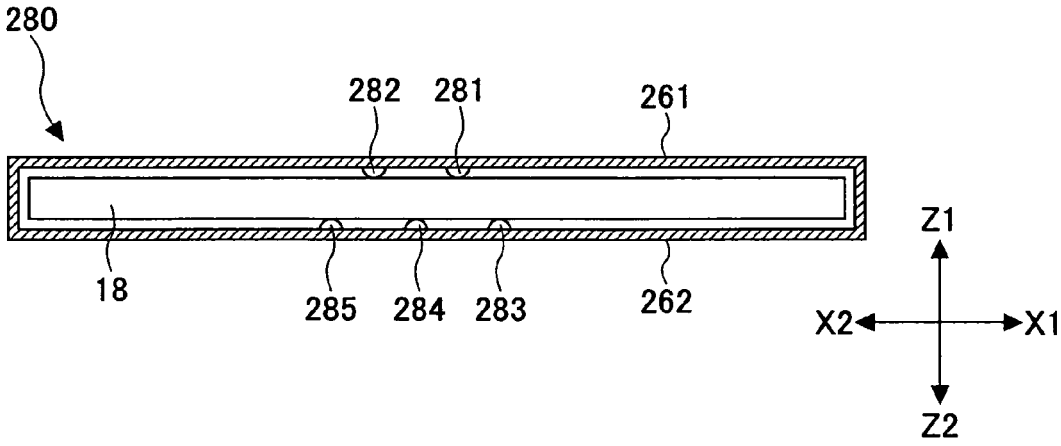
FIG. 18 is a cross-sectional diagram showing the connector protective cover of FIG. 17 being arranged over an inserting portion.

FIG. 18 is a cross-sectional diagram of the connector protective cover 280. As is shown in this drawing, the connector protective cover 280 is configured to cover the inserting portion 18 in a manner such that the inserting portion 18 is arranged between the protrusions 281, 281 and the protrusions 283, 284, 285 and held by frictional force. It is noted that the inner faces of the long side walls 261 and 262 do not come into contact with the inserting portion 18.

Tenth Embodiment

Figure 19:
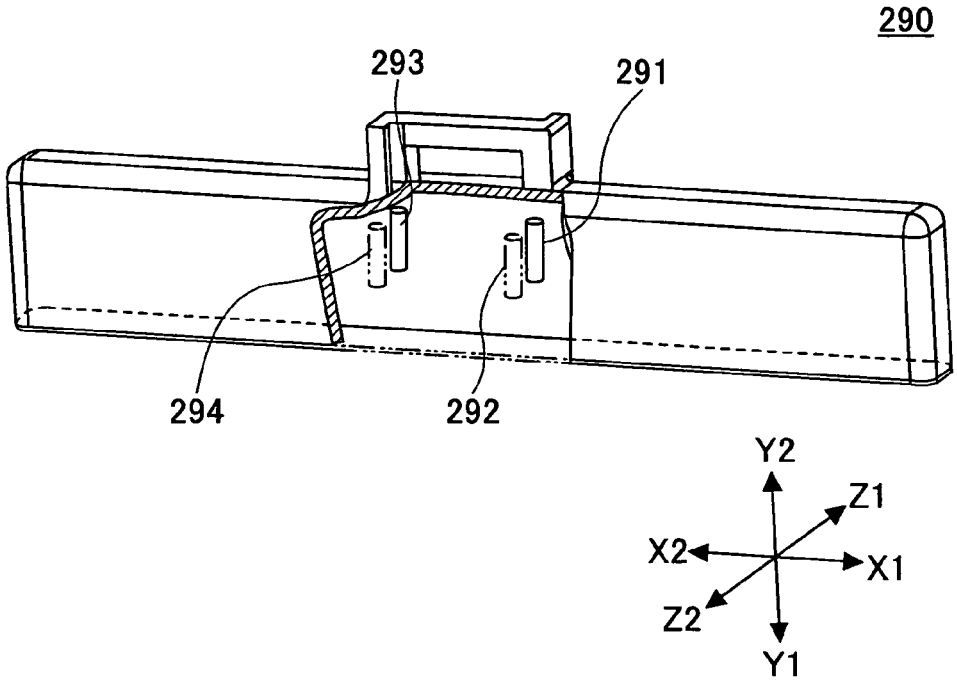
FIG. 19 is a diagram showing a connector protective cover according to a tenth embodiment of the present invention.

FIG. 19 is a diagram showing a connector protective cover 290 according to a tenth embodiment of the present invention. The connector protective cover 290 includes protrusions 291-294 arranged at the inner end portion, that is, the Y2 side portion of the inner faces of the long side walls 261 and 262.

Figure 20:
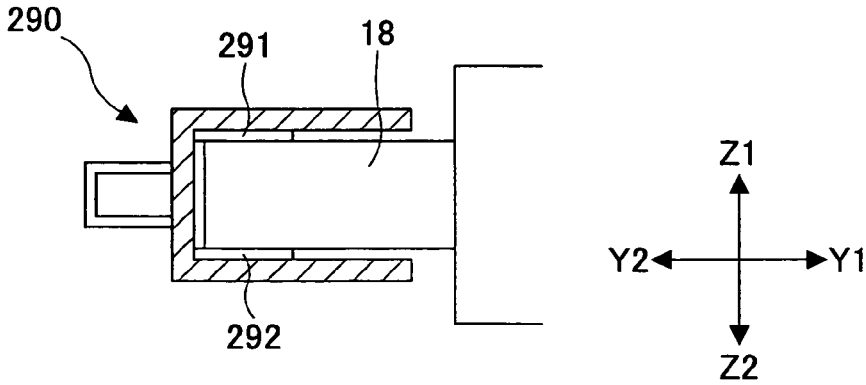
FIG. 20 is a cross-sectional diagram showing the connector protective cover of FIG. 19 being arranged over an inserting portion.

FIG. 20 is a cross-sectional diagram showing the connector protective cover 290 arranged over the inserting portion 18. As is shown in this drawing, the connector protective cover 290 is configured to cover the inserting portion 18 in a manner such that the tip portion of the inserting portion 18 is arranged between the protrusions 291-294 and held by frictional force. It is noted that the inner faces of the long side walls 261 and 262 do not come into contact with the inserting portion 18.

Also, it is noted that the present embodiment of arranging the protrusions 291-294 at the inner end portions of the long side walls 261 and 262 may similarly be applied to the connector protective cover 260 according to the seventh embodiment as is illustrate in FIG. 13 or the connector protective cover 280 according to the ninth embodiment as is illustrated in FIG. 17.

Eleventh Embodiment

Figure 21:
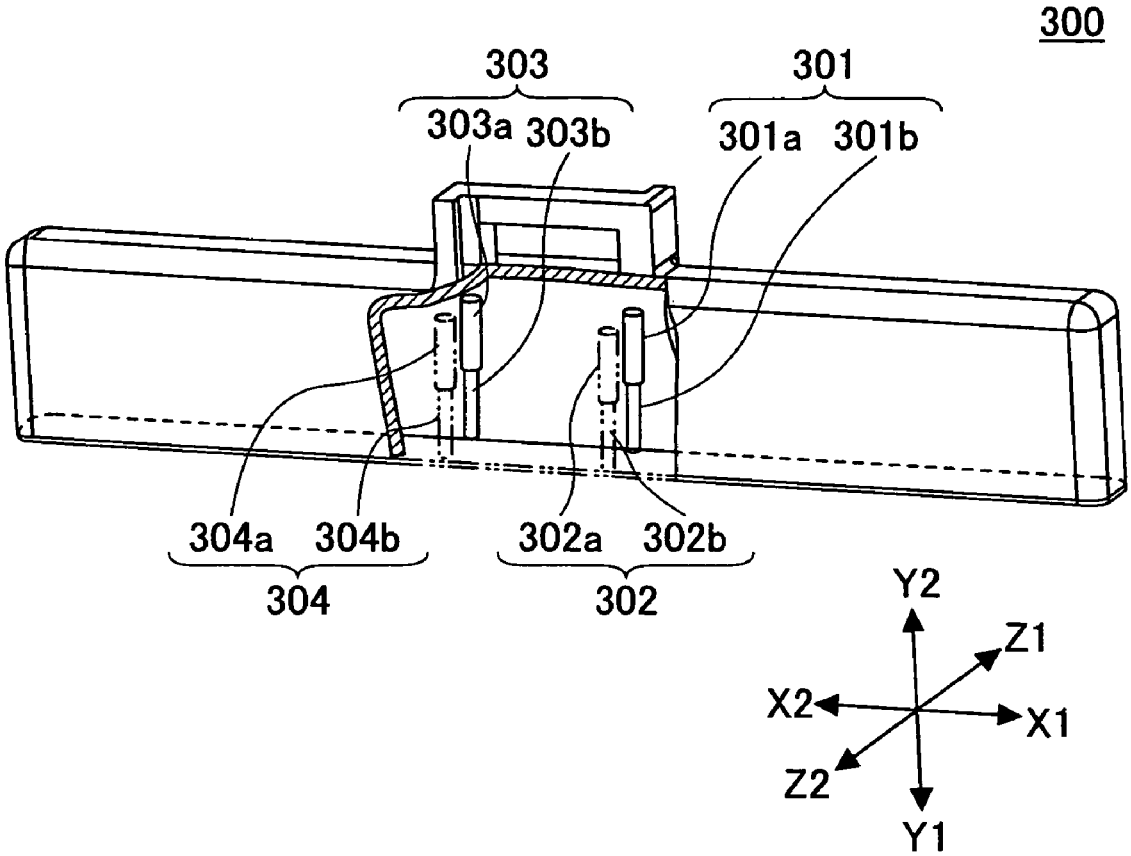
FIG. 21 is a diagram showing a connector protective cover according to an eleventh embodiment of the present invention.

FIG. 21 is a diagram showing a connector protective cover 300 according to an eleventh embodiment of the present invention. The connector protective cover 300 includes protrusions 301-304 arranged at the inner faces of the long side walls 261 and 262. The protrusions 301-304 respectively include Y2 side higher protruding portions 301*a*-304*a* and opening side lower protruding portions 301*b*-304*b*. It is noted that the lower protruding portions 301*b*-304*b* act as guides.

Figure 22A:
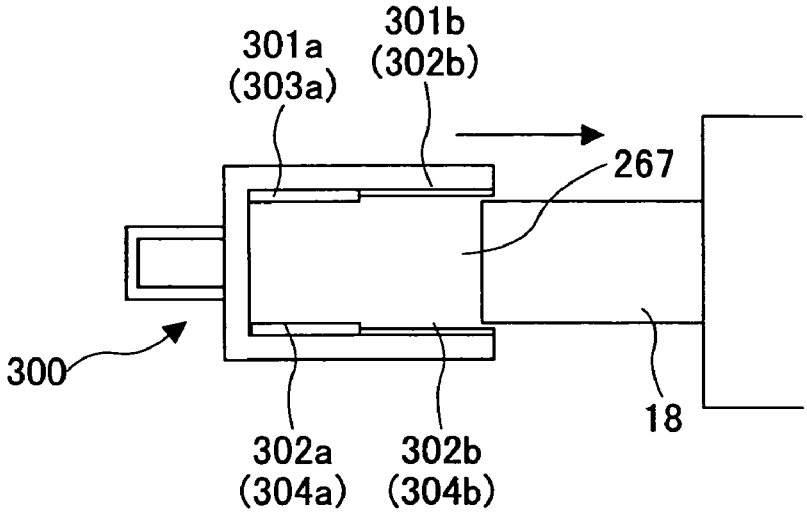
FIGS. 22A and 22B are cross-sectional diagrams showing the connector protective cover of FIG. 21 being arranged over an inserting portion.
Figure 22B:
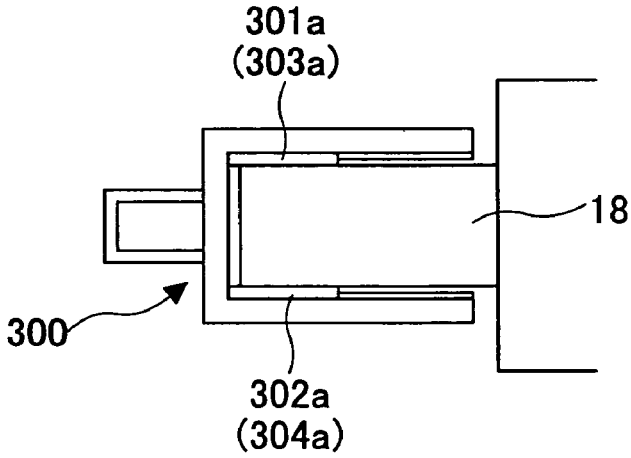

FIGS. 22A and 22B are cross-sectional diagrams showing the connector protective cover 300 arranged over the inserting portion 18. As is shown in FIG. 22A, the connector protective cover 300 is guided by the lower protruding portions 301*b*-304*b* and the opening 267 is arranged to engage the inserting portion 18. Then, the higher protruding portions 301*a*-304*a* engages the inserting portion 18 so that the tip portion of the inserting portion 18 is arranged between the higher protruding portions 301*a*-304*a*, and the inserting portion 18 is held by frictional force and covered by the connector protective cover 300 as is shown in FIG. 22B. By creating the lower protruding portions 301*b*-304*b* at the opening 267 side, the play of the connector protective cover 300 with respect to the inserting portion 18 at the initial stage of arranging the connector protective cover 300 over the inserting portion 18 may be regulated so that the connector protective cover 300 may be smoothly arranged over the inserting portion 18.

It is noted that the present embodiment of arranging lower protruding portions 301*b*-304*b* at the opening 267 side may similarly be applied to the connector protective cover 260 of the seventh embodiment as is illustrated in FIG. 13 and the connector protective cover 280 of the ninth embodiment as is illustrated in FIG. 17.

Twelfth Embodiment

Figure 23:
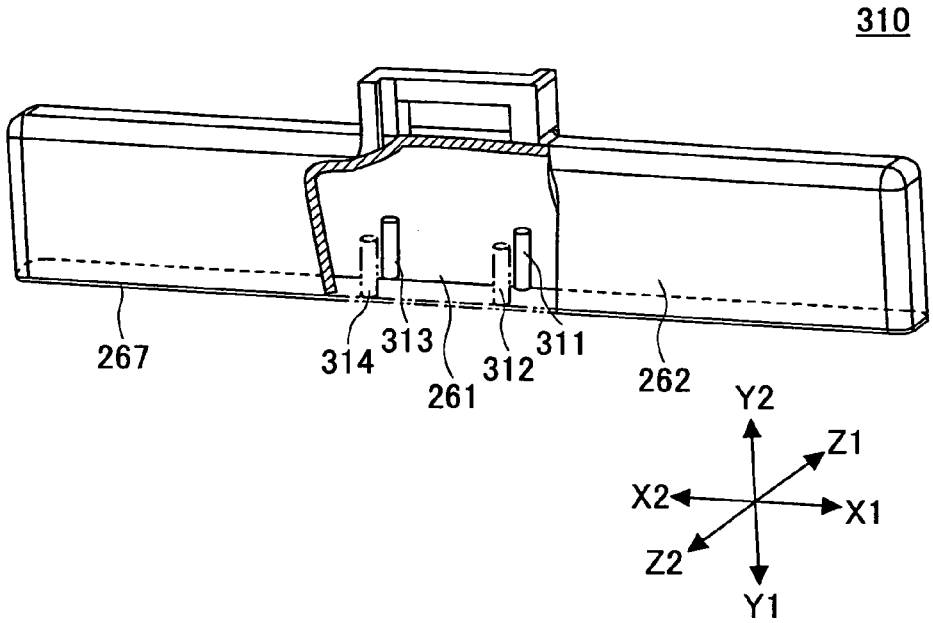
FIG. 23 is a diagram showing a connector protective cover according to a twelfth embodiment of the present invention.
Figure 24:
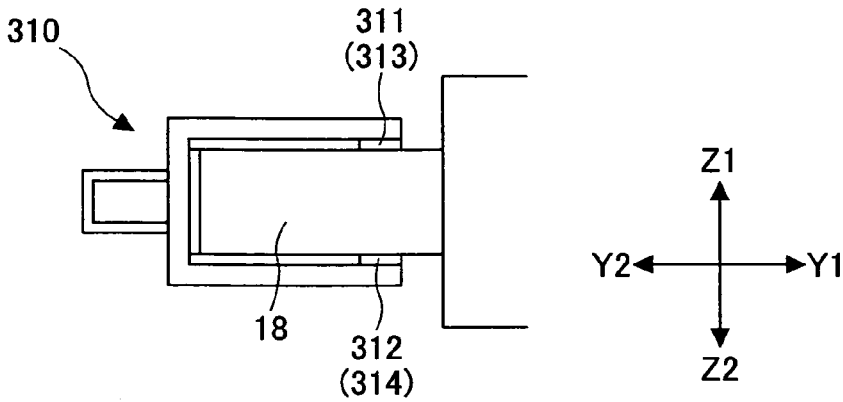
FIG. 24 is a cross-sectional diagram showing the connector protective cover of FIG. 23 being arranged over an inserting portion.

FIG. 23 is a diagram showing a connector protective cover 310 according to a twelfth embodiment of the present invention. The connector protective cover 310 includes protrusions 311-314 arranged at the Y1 side toward the opening 267 of the inner faces of the long side walls 261 and 262. The connector protective cover 310 is configured to cover the inserting portion 18 in a manner such that the base portion of the inserting portion 18 is arranged between the protrusions 311-314 and held by frictional force. It is noted that the inner faces of the long side walls 261 and 262 do not come into contact with the inserting portion 18.

Also, it is noted that the present embodiment of arranging the protrusions 311-314 near the opening 267 may similarly be applied to the connector protective cover 260 of the seventh embodiment as is illustrated in FIG. 13 and the connector protective cover 280 of the ninth embodiment as is illustrated in FIG. 17.

Thirteenth Embodiment

It is noted that thirteenth through eighteenth embodiments of the present invention relate to arrangements made on the inserting portion 18 of the cable side connector 10 shown in FIG. 1 so that the connector protective cover may not easily be detached from the inserting portion 18.

Figure 25A:
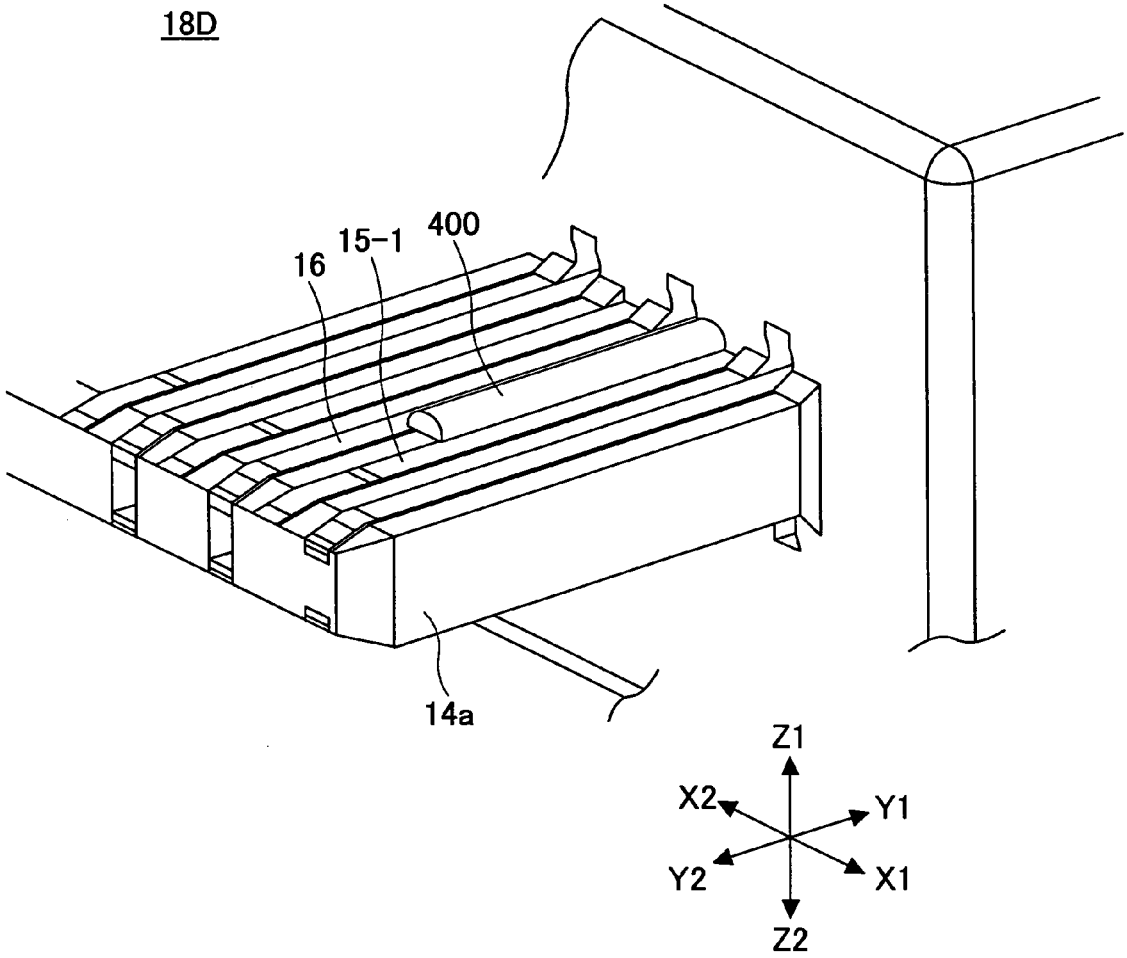
FIGS. 25A and 25B are diagrams showing an inserting portion of a cable side connector according to a thirteenth embodiment of the present invention.
Figure 25B:
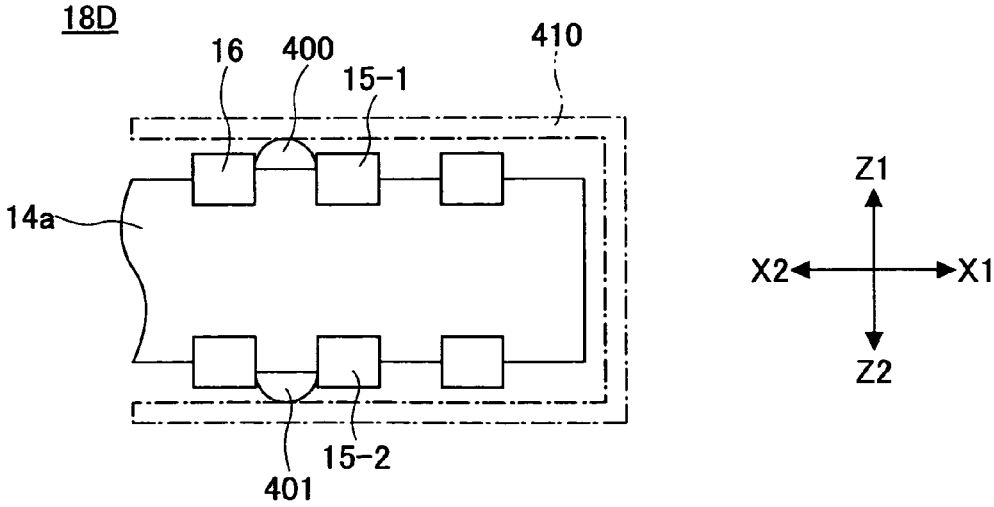

FIGS. 25A and 25B are diagrams showing an inserting portion 18D of a cable side connector according to a thirteenth embodiment of the present invention. The inserting portion 18D of the present embodiment includes protrusions 400 and 401 extending across the plate portion 14*a* in the Y directions. The protrusions 400 and 401 are integrally formed with the molded part 14 shown in FIG. 2 through molding, and are arranged between the signal contact 15-1/15-2 and the ground contact 16.

Figure 26A:
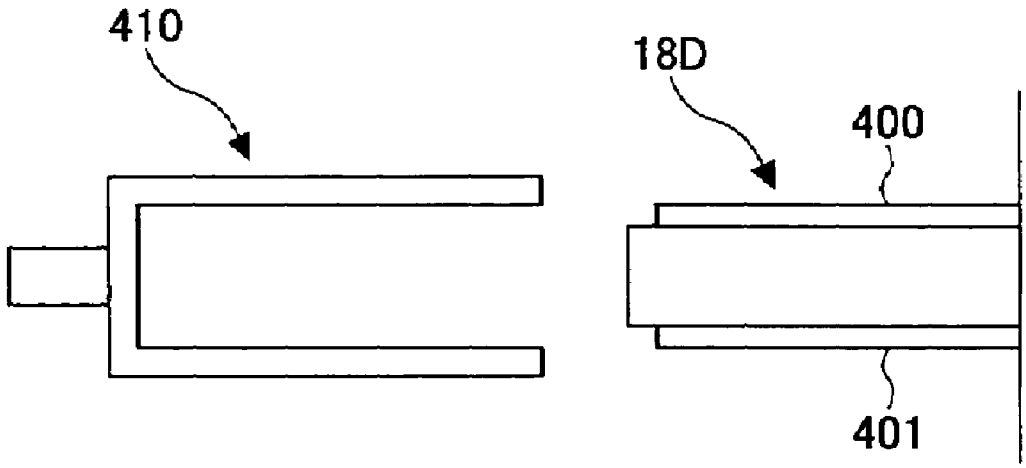
FIGS. 26A and 26B are cross-sectional diagrams showing the inserting portion of FIGS. 25A and 25B being covered by a connector protective cover.
Figure 26B:
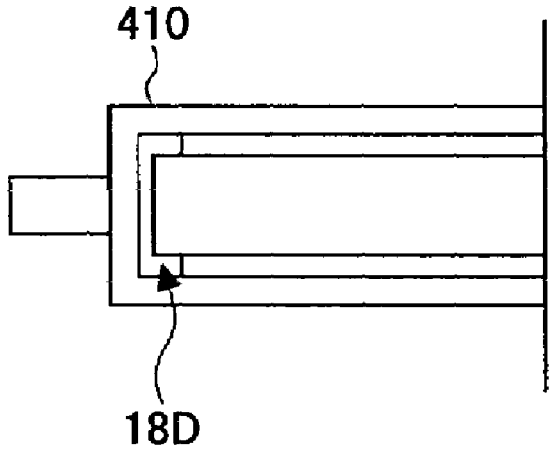

FIGS. 26A and 26B are diagrams illustrating a connector protective cover 410 being arranged over the inserting portion 18D. As is shown in these drawings, the connector protective cover 410 is arranged to cover the inserting portion 18D by having its inner walls come into contact with the protrusions 400 and 401 to hold the inserting portion 18D by frictional force.

Fourteenth Embodiment

Figure 27:
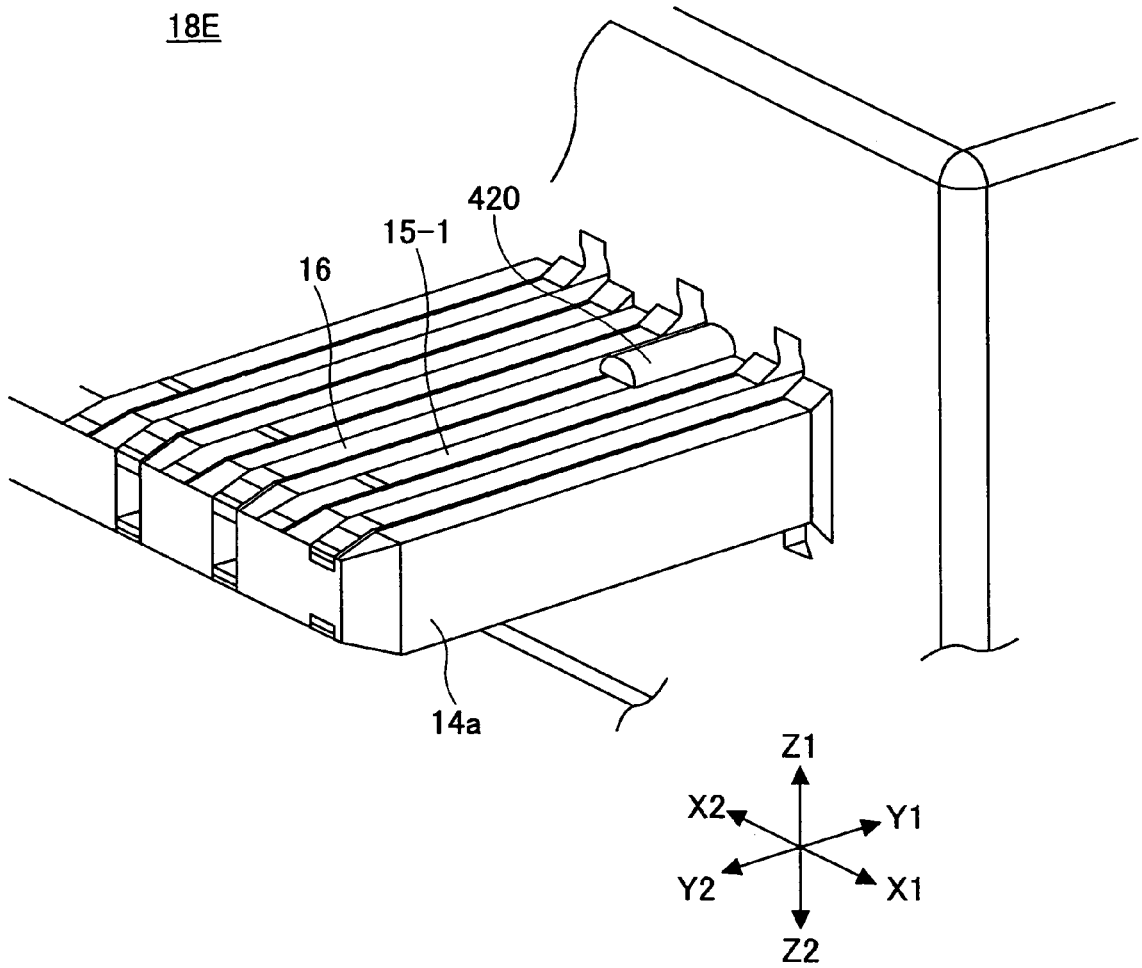
FIG. 27 is a diagram showing an inserting portion of a cable side connector according to a fourteenth embodiment of the present invention.

FIG. 27 is a diagram showing an inserting portion 18E of a cable side connector according to a fourteenth embodiment of the present invention. The inserting portion 18E of the present embodiment includes a protruding portion 420 arranged at the base portion side (Y1 side) of the plate portion 14*a*. The protrusion 420 is integrally formed with the molded part 14 shown in FIG. 2 through molding, and is arranged between the signal contact 15-1/15-2 and the ground contact 16.

In the present embodiment, a connector protective cover is arranged to cover the inserting portion 18E by having its inner face come into contact with the protrusion 420 to hold the inserting portion 18E by frictional force.

Fifteenth Embodiment

Figure 28:
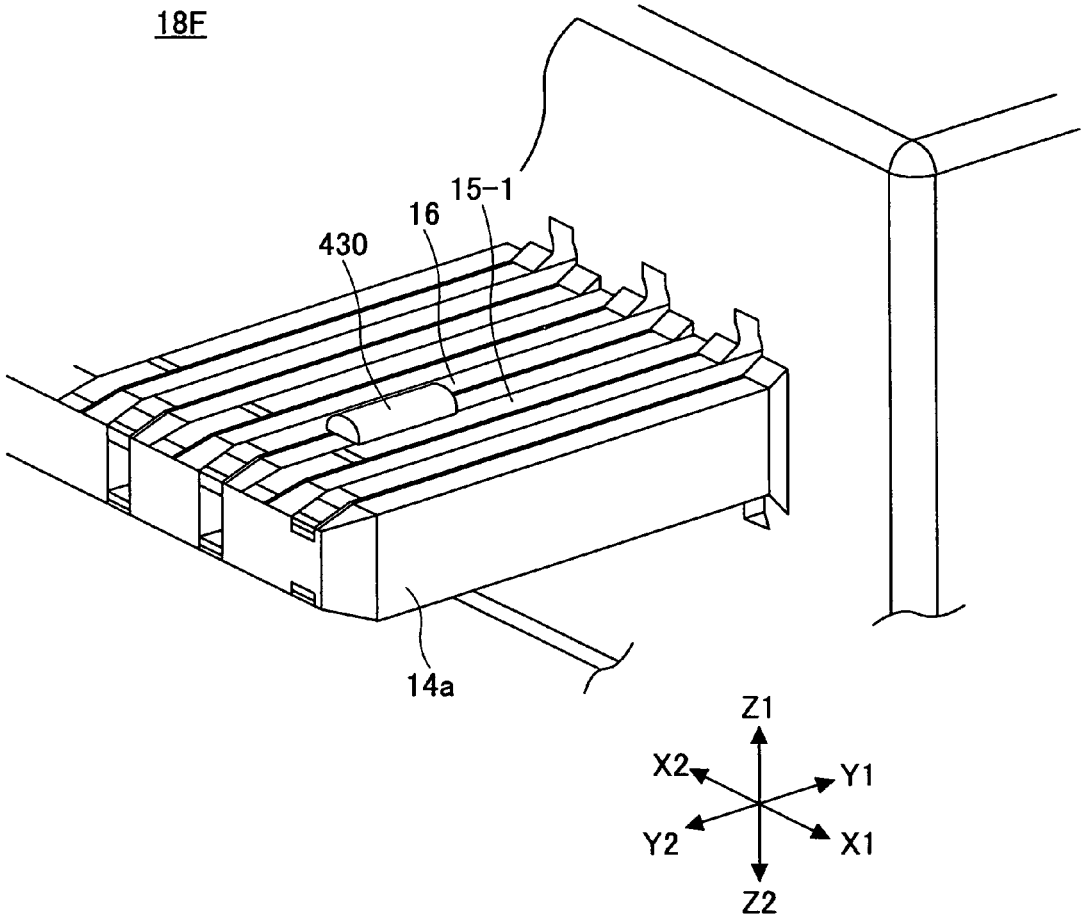
FIG. 28 is a diagram showing an inserting portion of a cable side connector according to a fifteenth embodiment of the present invention.

FIG. 28 is a diagram showing an inserting portion 18F of a cable side connector according to a fifteenth embodiment of the present invention. The inserting portion 18F includes a protrusion 430 arranged at the tip portion side (Y2 side) of the plate portion 14*a*. The protrusion 430 is integrally formed with the molded part 14 shown in FIG. 2 through molding, and is arranged between the signal contact 15-1/15-2 and the ground contact 16.

In the present embodiment, a connector protective cover is arranged to cover the inserting portion 18F by having its inner face come into contact with the protrusion 430 to hold the inserting portion 18F by frictional force.

Sixteenth Embodiment

Figure 29A:
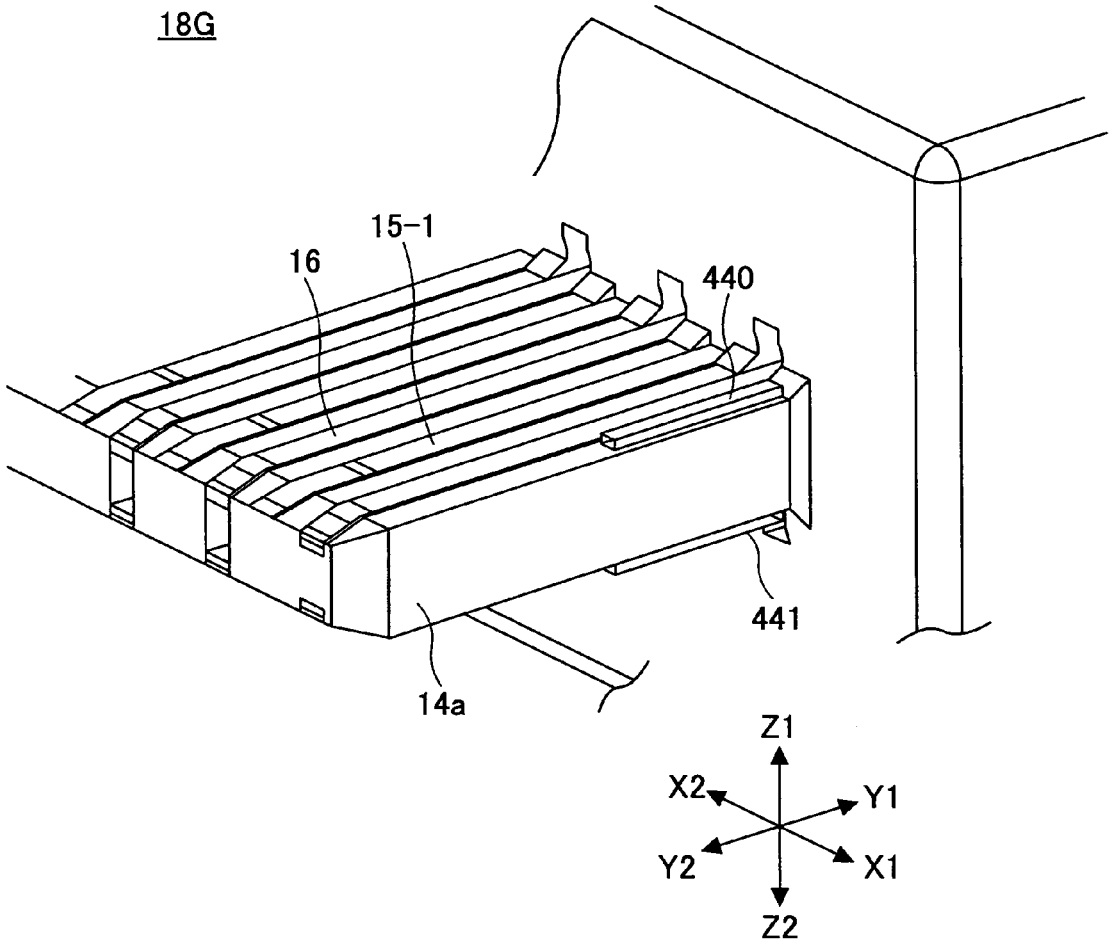
FIGS. 29A and 29B are diagrams showing an inserting portion of a cable side connector according to a sixteenth embodiment of the present invention.
Figure 29B:
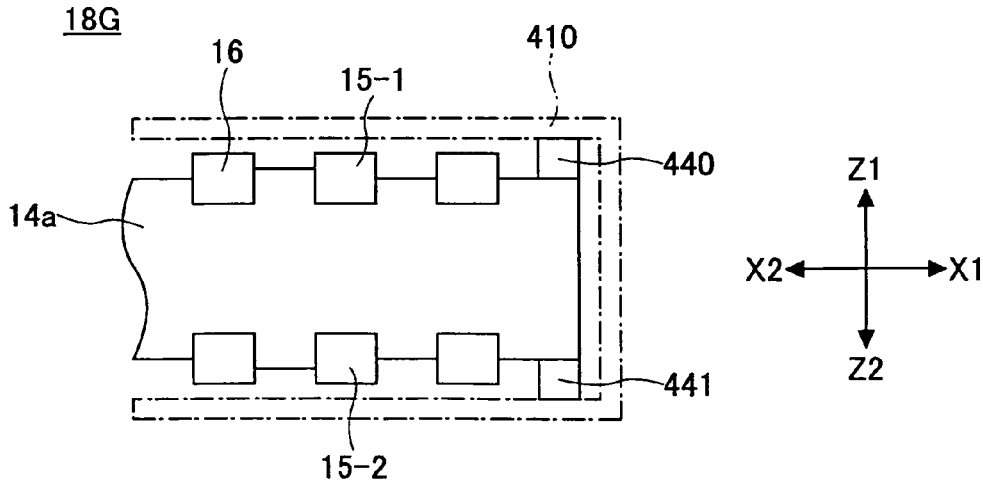

FIGS. 29A and 29B are diagrams showing an inserting portion 18G of a cable side connector according to a sixteenth embodiment of the present invention. The inserting portion 18G includes a protrusion 440 arranged at the X1 side of the Z1 side face of the plate portion 14*a* and a protrusion 441 arranged at the X1 side of the Z2 side face of the plate portion 14*a*. It is noted that protrusions are similarly arranged at the X2 side of the plate portion 14*a*. The protrusions 440 and 441 are integrally formed with the molded part 14 shown in FIG. 2 through molding.

As is shown in FIG. 29B, in the present embodiment, the connector protective cover 410 is arranged to cover the inserting portion 18G by having its inner faces come into contact with the protrusions 440 and 441 to hold the inserting portion 18G by frictional force.

Seventeenth Embodiment

Figure 30A:
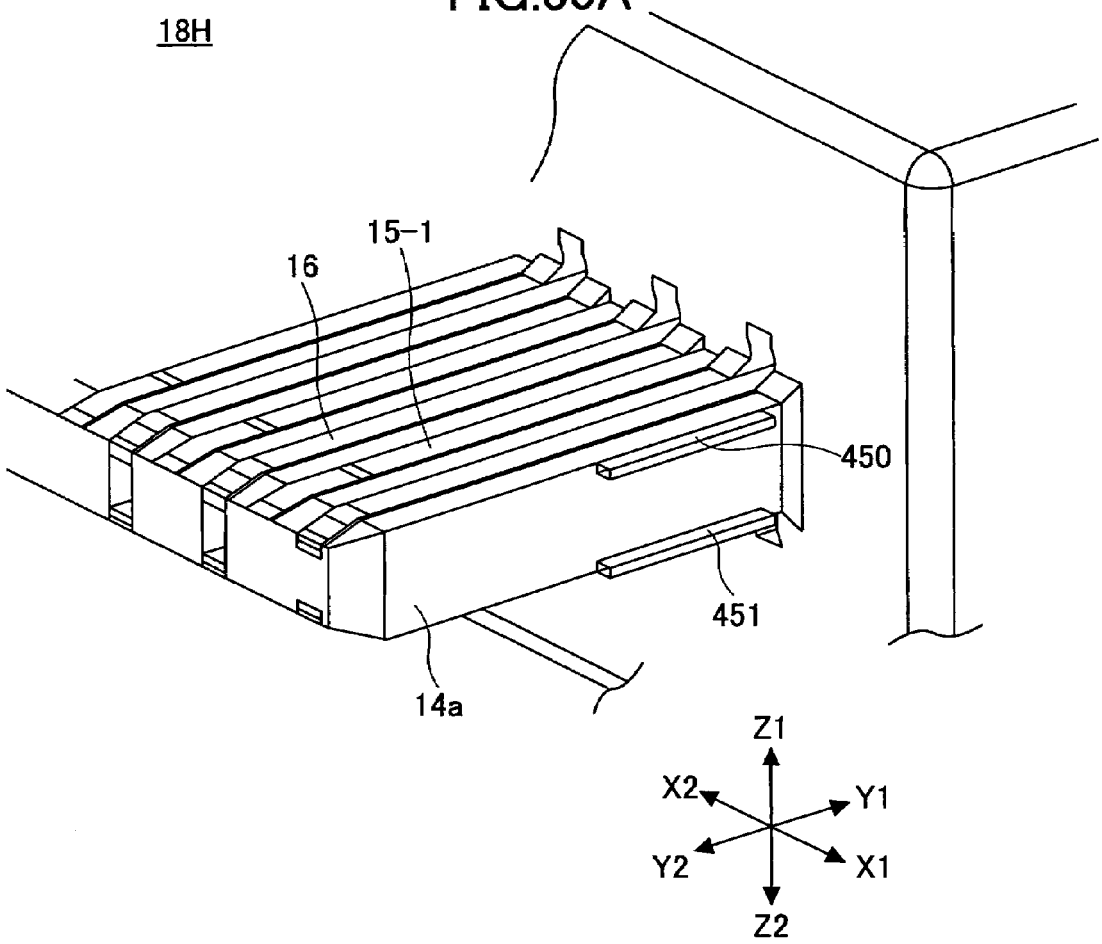
FIGS. 30A and 30B are diagrams showing an inserting portion of a cable side connector according to a seventeenth embodiment of the present invention.
Figure 30B:
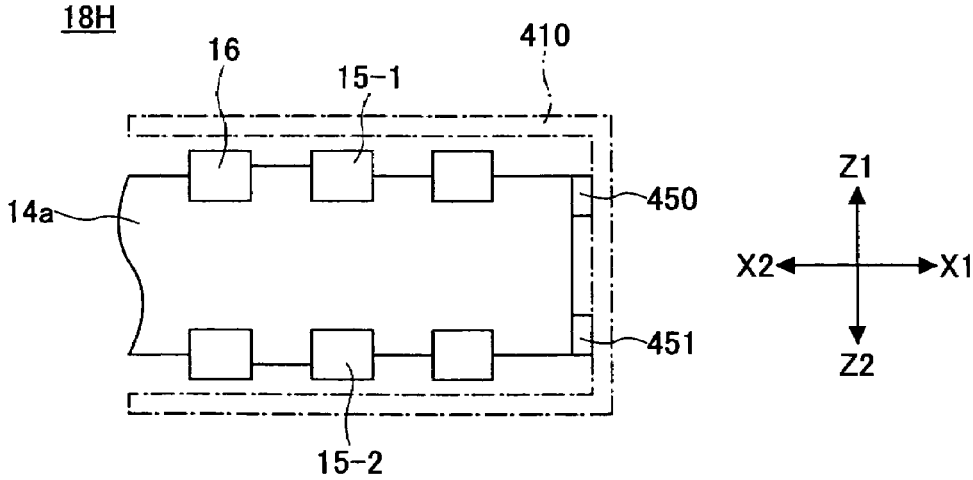

FIGS. 30A and 30B are diagrams showing an inserting portion 18H of a cable side connector according to a seventeenth embodiment of the present invention. The inserting portion 18H includes a protrusion 450 arranged at the Z1 side of the X1 side face of the plate portion 14*a* and a protrusion 451 arranged at the Z2 side of the X1 side face of the plate portion 14*a*. It is noted that protrusions are similarly arranged at the X2 side face of the plate portion 14*a*. The protrusions 450 and 451 are integrally formed with the molded part 14 shown in FIG. 2 through molding.

As is shown in FIG. 30B, in the present embodiment, the connector protective cover 410 is arranged to cover the inserting portion 18H by having its inner face come into contact with the protrusions 450 and 451 to hold the inserting portion 18H by frictional force.

Eighteenth Embodiment

Figure 31A:
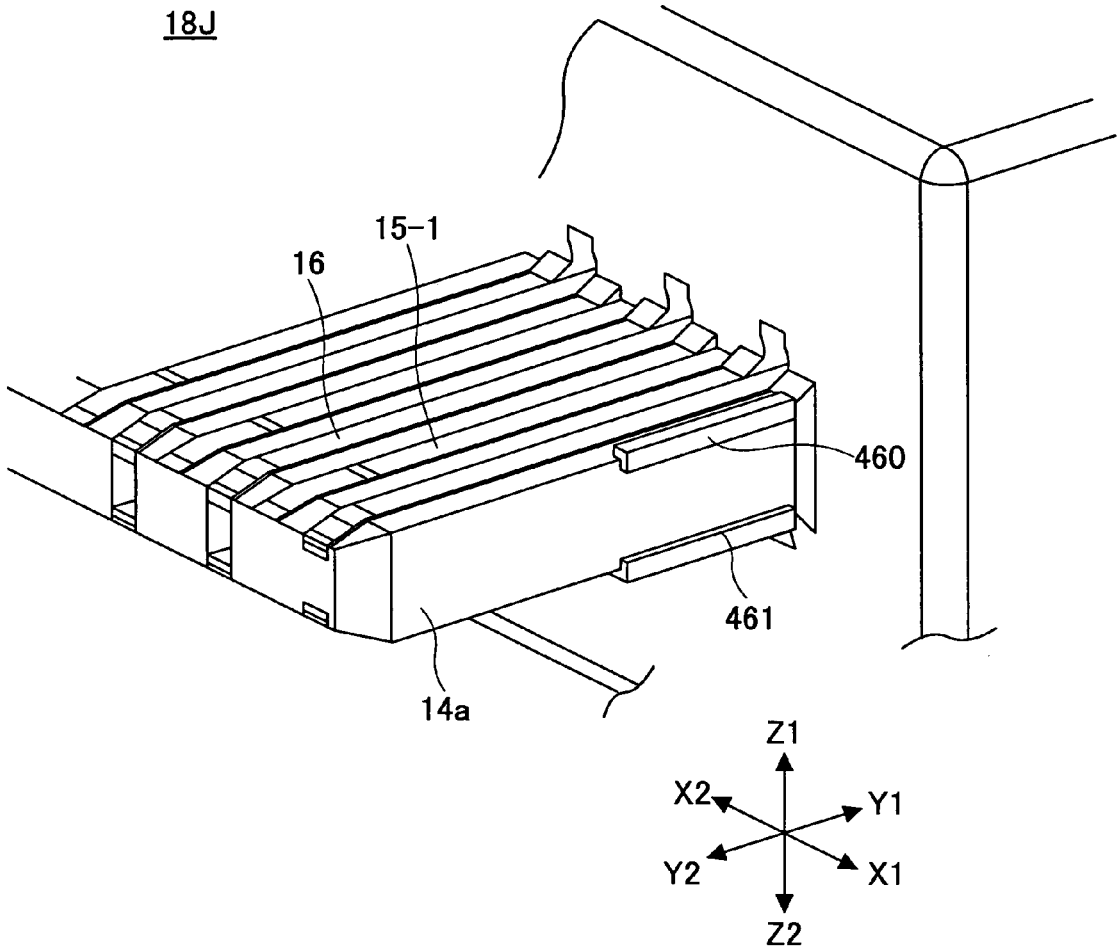
FIGS. 31A and 31B are diagrams showing an inserting portion of a cable side connector according to an eighteenth embodiment of the present invention.
Figure 31B:
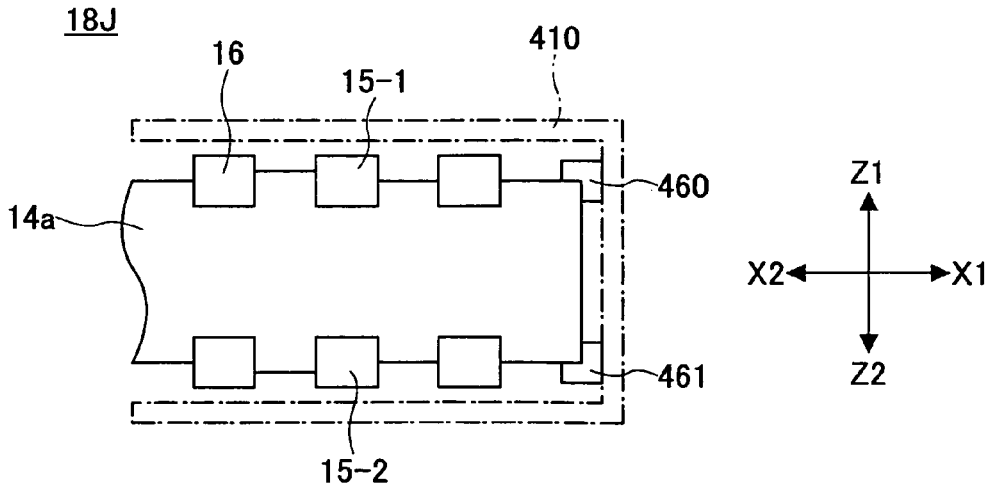

FIGS. 31A and 31B are diagrams showing an inserting portion 18J of a cable side connector according to an eighteenth embodiment of the present invention. The inserting portion 18J includes a protrusion 460 arranged across a X1 side face portion and a Z1 side face portion of the plate portion 14*a* and a protrusion 461 arranged across a X1 side face portion and a Z2 side face portion of the plate portion 14*a*. It is noted that protrusions are similarly arranged at the X2 side of the plate portion 14*a*. The protrusions 460 and 461 are integrally formed with the molded part 14 shown in FIG. 2 through molding.

As is shown in FIG. 31B, in the present embodiment, the connector protective cover 410 is arranged to cover the inserting portion 18J by having its inner faces come into contact with the protrusions 460 and 461 to hold the inserting portion 18J by frictional force.

Further, the present invention is not limited to these embodiments, and variations and modifications may be made without departing from the scope of the present invention.

The present application is based on and claims the benefit of the earlier filing date of Japanese Patent Application No. 2005-309270 filed on Oct. 25, 2005, the entire contents of which are hereby incorporated by reference.

What is claimed is:

1. A connector having a removable connector protective cover, said connector comprising:

a shield cover assembly having an enclosure portion at an edge thereof;

a molded part having a protruding plate portion; and an inserting portion exposed within the enclosure portion and having signal contacts, a ground contact arranged on the protruding plate portion, and a concave portion, said connector protective cover comprising:

a top plate portion, at least four side wall portions having first ends connected to the top plate portion and having second ends defining an opening, and a cantilever portion arranged at one edge of the four side wall portions and extending in a direction from the opening towards the top plate, said cantilever portion having a protruding portion which protrudes towards an inside of the connector protective cover and is configured to engage the concave portion of the inserting portion and maintain engagement between the inserting portion of the connector and the connecter protective cover in a state in which the connector protective cover is attached to the connector;

wherein the second ends of the at least four side wall portions defining the opening make continuous contact with a flat surface of the protruding plate portion of the molded part in the state in which the connector protective cover is attached to the connector.

2. The connector as claimed in claim 1, wherein:

the at least four side wall portions of the connector protective cover include a first pair of side wall portions opposing each other, and a second pair of side wall portions opposing each other and having sides shorter than those of the first pair of side wall portions; and the cantilever portion is arranged on one of the second pair of side wall portions.

3. The connector as claimed in claim 2, wherein the second ends of the at least four side wall portions defining the opening make contact with the protruding plate portion of the molded part in the state in which the connector protective cover is attached to the connector.

4. The connector as claimed in claim 3, wherein the concave portion of the inserting portion is located at a position so that the protruding portion of the cantilever portion engages the concave portion when the second ends of said at least four side wall portions defining the opening make contact with the protruding plate portion of the molded part.

5. The connector as claimed in claim 1, wherein the concave portion of the inserting portion is located at a position so that the protruding portion of the cantilever portion engages the concave portion when the second ends of the at least four side wall portions defining the opening make continuous contact with a flat surface the protruding plate portion of the molded part.

6. The connector as claimed in claim 2, wherein the cantilever portion is flexible, and the protruding portion is located at a tip end of the cantilever portion.

* * * * *